US008743014B2

(12) United States Patent
Kondo et al.

(10) Patent No.: US 8,743,014 B2
(45) Date of Patent: Jun. 3, 2014

(54) ANTENNA DEVICE AND WIRELESS COMMUNICATION TERMINAL

(75) Inventors: Toshinori Kondo, Osaka (JP); Hiroyuki Takebe, Osaka (JP); Mikio Kuramoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 293 days.

(21) Appl. No.: 13/057,995

(22) PCT Filed: May 26, 2010

(86) PCT No.: PCT/JP2010/058911

§ 371 (c)(1),
(2), (4) Date: Feb. 7, 2011

(87) PCT Pub. No.: WO2011/013438

PCT Pub. Date: Feb. 3, 2011

(65) Prior Publication Data

US 2011/0134014 A1 Jun. 9, 2011

(30) Foreign Application Priority Data

Jul. 27, 2009 (JP) ..... 2009-174619

(51) Int. Cl.
*H01Q 3/24* (2006.01)

(52) U.S. Cl.
USPC ..... 343/876; 343/702; 343/777

(58) Field of Classification Search
CPC ..... H01Q 3/24; H01Q 21/28; H01Q 1/243
USPC ..... 343/876, 702, 777
See application file for complete search history.

(56) References Cited

U.S. PATENT DOCUMENTS

2007/0188392 A1* 8/2007 Kanazawa et al. ..... 343/702
2007/0273606 A1* 11/2007 Mak et al. ..... 343/876
2008/0018539 A1 1/2008 Jung et al.
2010/0279747 A1 11/2010 Imano et al.
2011/0057857 A1 3/2011 Nagano et al.

FOREIGN PATENT DOCUMENTS

| | | | |
|---|---|---|---|
| JP | 2004-274445 | A | 9/2004 |
| JP | 2006-86617 | A | 3/2006 |
| JP | 2007-68153 | A | 3/2007 |
| JP | 2007-221288 | A | 8/2007 |
| JP | 2008-29001 | A | 2/2008 |
| JP | 2009-165082 | A | 7/2009 |
| WO | WO 2009/019782 | A1 | 2/2009 |

OTHER PUBLICATIONS

Antenna Frequency Scaling The ARRL Antenna Book 1988 pp. 2-24to2-25.*

Lin et al., "Printed Monopole Slot Antenna for Internal Multiband Mobile Phone Antenna," IEEE Transactions on Antennas and Propagation, vol. 55, No. 12, Dec. 2007, pp. 3690-3697.

* cited by examiner

*Primary Examiner* — Dameon E Levi
*Assistant Examiner* — Collin Dawkins
(74) *Attorney, Agent, or Firm* — Birch, Stewart, Kolasch & Birch, LLP

(57) ABSTRACT

At least three resonance frequencies are obtained by two antenna elements. The antenna device includes antenna elements (11) and (12), a wireless section (20) for supplying power to each of the antenna elements (11) and (12), a PIN diode (16) for electrically connecting and disconnecting the antenna element (11) and the wireless section (20) with/from each other, the antenna elements (11) and (12) being provided so as to be capacitively coupled to each other during the electrical disconnection between the antenna element (11) and the wireless section (20) which electrical disconnection is made by the PIN diode (16).

11 Claims, 29 Drawing Sheets

ANTENNA DEVICE AND WIRELESS COMMUNICATION TERMINAL

TECHNICAL FIELD

The present invention relates to an antenna device and a wireless communication terminal each of which is capable of changing a resonance frequency.

BACKGROUND ART

Generally, in order to obtain resonance at different frequencies in an antenna device, it is only necessary to provide the antenna device with antenna elements as many as the number of the different frequencies and a transmitting/receiving circuit for causing the antenna elements to operate. However, it is necessary to secure a large space in an antenna device so as to provide an additional antenna element and a transmitting/receiving circuit. Namely, as the number of frequencies at which resonance occurs increases in an antenna device, the antenna device becomes larger.

In view of the circumstances, ways and means to miniaturize an antenna device while obtaining resonance at different frequencies have been suggested.

For example, Patent Literature 1 discloses an antenna device which causes a switch to connect/disconnect two antenna elements with/from each other.

According to the antenna device disclosed in Patent Literature 1, a change made by the switch causes the antenna device to resonate with signals of two kinds of frequencies by changing a substantial length (hereinafter referred to as an electrical length) of an antenna operating as an antenna, so as to miniaturize the antenna device by causing circuits required to be provided for respective antenna elements to be shared.

CITATION LIST

Patent Literature 1

Japanese Patent Application Publication, Tokukai, No. 2008-29001 A (Publication Date: Feb. 7, 2008)

SUMMARY OF INVENTION

Technical Problem

However, according to the prior art as described above, only at most two kinds of resonance frequencies can be obtained by two antenna elements since electrical lengths of two antenna elements are changed merely by electrically connecting and disconnecting the two antenna elements with/from each other.

The present invention has been made in view of the problems, and an object of the present invention is to provide an antenna device which is capable of obtaining at least three resonance frequencies by two antenna elements, and a wireless communication terminal.

Solution to Problem

In order to attain the object, an antenna device according to the present invention includes: a first antenna element; a second antenna element; a power supply section for supplying power to each of the first antenna element and the second antenna element; and a switching element for electrically connecting and disconnecting the first antenna element and the power supply section with/from each other, the first antenna element and the second antenna element being provided so as to be capacitively coupled to each other during the electrical disconnection between the first antenna element and the power supply section which electrical disconnection is made by the switching element.

According to the arrangement, each of the first antenna element and the second antenna element operates as a ¼ wavelength antenna at a corresponding specified resonance frequency in response to a power supply from the power supply section during the electrical connection between the first antenna element and the power supply section which electrical connection is made by the switching element in a first power supply path.

In contrast, the first antenna element and the second antenna element are in a state in which a charge exchange occurs therebetween, i.e., they are capacitively coupled (hereinafter referred to as "electrically coupled") during the electrical disconnection between the first antenna element and the power supply section which electrical disconnection is made by the switching element in the first power supply path.

This allows the first antenna element to receive power from the power supply section via the second antenna element.

In this case, the first antenna element operates as a ½ wavelength antenna since both ends of the first antenna element are open. Accordingly, the first antenna element resonates at a higher resonance frequency than in the case of the electrical connection between the first antenna element and the power supply section.

Namely, it is possible to change operation as an antenna of the first antenna element by causing the switching element to electrically connect/disconnect the first antenna element and the power supply section with/from each other.

The second antenna element, which operates as a ¼ wavelength antenna in response to a power supply from the power supply section even during the electrical disconnection between the first antenna element and the power supply section which disconnection is made by the switching element, has a longer electrical length by being electrically connected to the first antenna element due to the capacitive coupling. According to this, the second antenna element resonates at a lower frequency than in the case of the electrical connection between the first antenna element and the power supply section.

As a result, it is possible to cause the first antenna element and the second antenna element to operate at different frequencies, depending on whether the first antenna element and the power supply section are electrically connected or disconnected with/from each other.

Namely, it is possible to obtain at least three resonance frequencies by the first antenna element and the second antenna element.

Advantageous Effects of Invention

An antenna device according to the present invention includes: a first antenna element; a second antenna element; a power supply section for supplying power to each of the first antenna element and the second antenna element; and a switching element for electrically connecting and disconnecting the first antenna element and the power supply section with/from each other, the first antenna element and the second antenna element being provided so as to be capacitively coupled to each other during the electrical disconnection between the first antenna element and the power supply section which electrical disconnection is made by the switching element.

This brings about an effect of obtaining at least three resonance frequencies by two antenna elements.

For a fuller understanding of the nature and advantages of the invention, reference should be made to the ensuing detailed description taken in conjunction with the accompanying drawings.

DESCRIPTION OF EMBODIMENTS

First Embodiment

An embodiment of an antenna device of the present invention is described below with reference to FIGS. 1 through 26.

Figure 2:
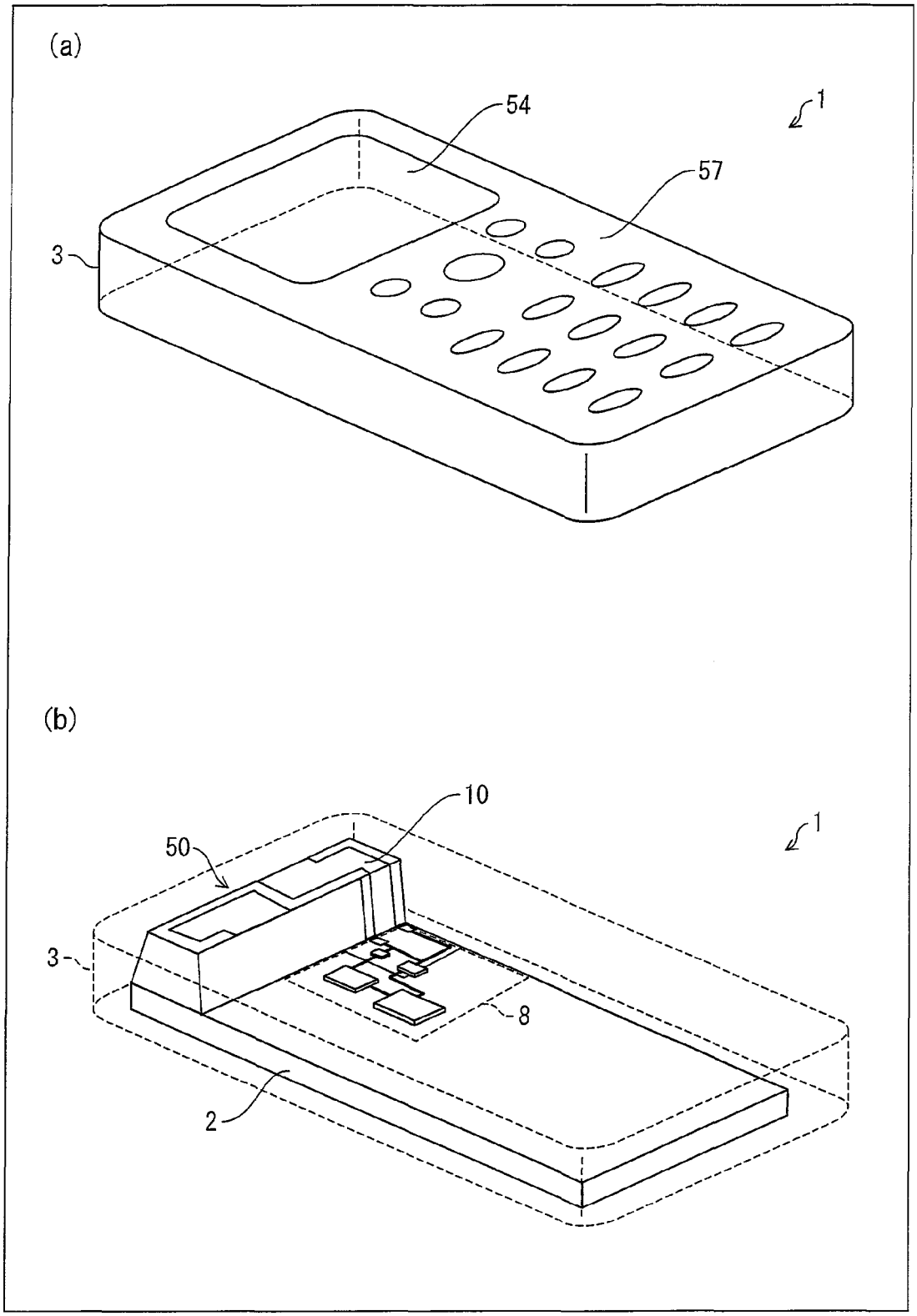
FIG. 2 has perspective views respectively illustrating mobile phones for each of which the antenna device according to the embodiment of the present invention is to be provided. (a) of FIG. 2 illustrates an appearance of the mobile phone, and (b) of FIG. 2 illustrates an antenna device and the like which are contained in a housing (not illustrated) of the mobile phone.

First, a mobile phone (wireless communication terminal) provided with an antenna device according to the present embodiment is to be described with reference to FIG. 2. FIG. 2 has perspective views respectively illustrating typical examples of a mobile phone for which the antenna device according to the present embodiment is to be provided. (a) of FIG. 2 illustrates an appearance of the mobile phone, and (b) of FIG. 2 illustrates an antenna device and the like which are contained in a housing (not illustrated) of the mobile phone.

(Appearance of Mobile Phone)

A mobile phone 1 provided with an antenna device 50 typically includes a housing 3 including a display section 54 and an operation section 57 (see (a) of FIG. 2). The display 54 carries out display for providing various pieces of information for a user. The operation section 57 receives operation carried out by the user. The mobile phone 1 can be connected to a communication system such as a mobile phone network in response to the operation received by the control section 57.

A circuit board 2 for variously controlling the mobile phone 1 is provided in the housing 3 of the mobile phone 1 (see (b) of FIG. 2). The circuit board 2 includes an antenna control section 8 for controlling an antenna. The antenna device 50 includes (i) the circuit board 2 including the antenna control section 8 and (ii) an antenna section 10.

Note that the housing 3 of the mobile phone 1 can be foldably or slidably structured, i.e., can have any structure.

(Various Functions of Mobile Phone)

Figure 3:
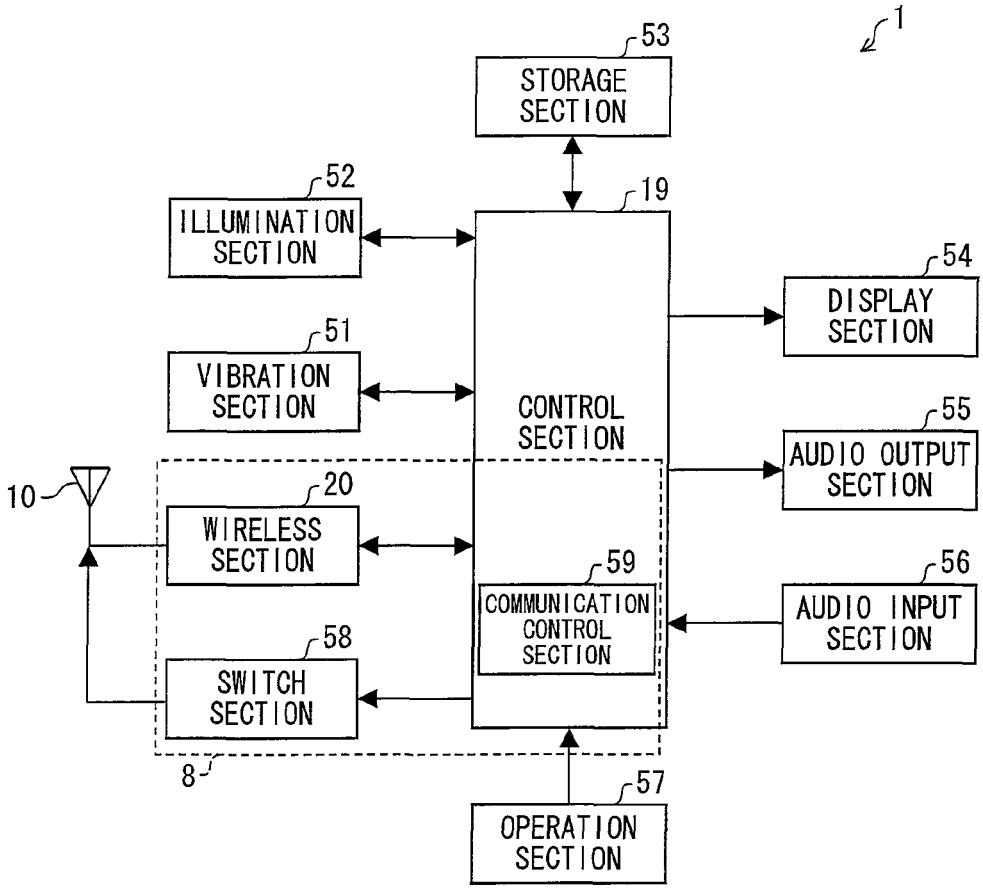
FIG. 3 is a functional block diagram schematically illustrating an arrangement of a mobile phone.

Next, various functions of the mobile phone 1 is to be described with reference to FIG. 3. FIG. 3 is a functional block diagram schematically illustrating an arrangement of a mobile phone.

The mobile phone 1 includes a control section 19, a vibration section 51, an illumination section 52, a storage section 53, the display section 54, an audio output section 55, an audio input section 56, the operation section 57, a wireless section (power supply section) 20, a switch section 58, and the antenna section 10 (see FIG. 3).

The control section 19 comprehensively controls various members of the mobile phone 1. A function of the control section 19 can be realized by, for example, causing a CPU (Central Processing Unit) to carry out a program stored in a storage element such as a RAM (Random Access Memory) or a flash memory. According to the present embodiment, the control section 19 particularly includes a communication control section 59 for controlling the switch section 58 and the wireless section 20.

The vibration section 51 causes a vibration element such as an eccentric motor to vibrate the mobile phone 1, so as to let the user know that a phone call has been received.

The illumination section 52 causes a light-emitting element such as an LED (a light emitting diode) to carry out light irradiation.

The storage section 53 stores various data and programs. The storage section 53 can be constituted by a flash memory, a ROM, a RAM, or the like.

The display section 54 receives image data from the control section 19 and displays an image on a display screen in accordance with the received image data. Specifically, an LCD (a Liquid Crystal Display) and an organic EL (Electro Luminescence) display, or the like is usable as the display section 54.

The audio output section 55 converts, to a sound wave, an audio signal supplied from the control section 19, so as to output the sound wave to outside. Specifically, the audio output section 55 includes a receiver, a speaker, a connector for audio output. For example, the mobile phone 1 is arranged such that the receiver is used for making a phone call and the speaker is used for letting the user know that a phone call has been received. Further, it is possible to connect the connector for audio output of the audio output section 55 to a headset, via which an audio is outputted.

The audio input section 56 converts an audio wave received from outside to an audio signal which is an electric signal, so as to transmit the audio signal to the control section 19. Specifically, the audio input section 56 includes a microphone.

The operation section 57 prepares operation data in response to operation carried out by the user with respect to an input device such as an operation button provided on a surface of the housing 3 included in the mobile phone 1, so as to transmit the operation data to the control section 19. A touch panel or the like other than a button switch is usable as the input device.

The wireless section 20 modulates, to a transmitted signal, transmitted data received from the control section 19, so as to transmit the modulated transmitted signal to outside via the antenna section 10. Further, the wireless section 20 demodulates, to received data, a received signal received from outside via the antenna section 10, so as to transmit the demodulated received data to the control section 19. Note that a circuit inside the wireless section 20 is selected by a filter or changed by a switch in accordance with a system (frequency band) to be used, so that the mobile phone 1 can be used in each communication system.

The switch section 58 changes a resonance frequency of the antenna section 10 in response to the control by the control section 19.

The antenna section 10 sends/receives a radio wave to/from outside.

Note that the antenna control section 8 illustrated in (b) of FIG. 2 corresponds to three functional blocks of the wireless section 20, the switch section 58, and the communication control section 59.

(Members of Antenna Device)

Figure 1:
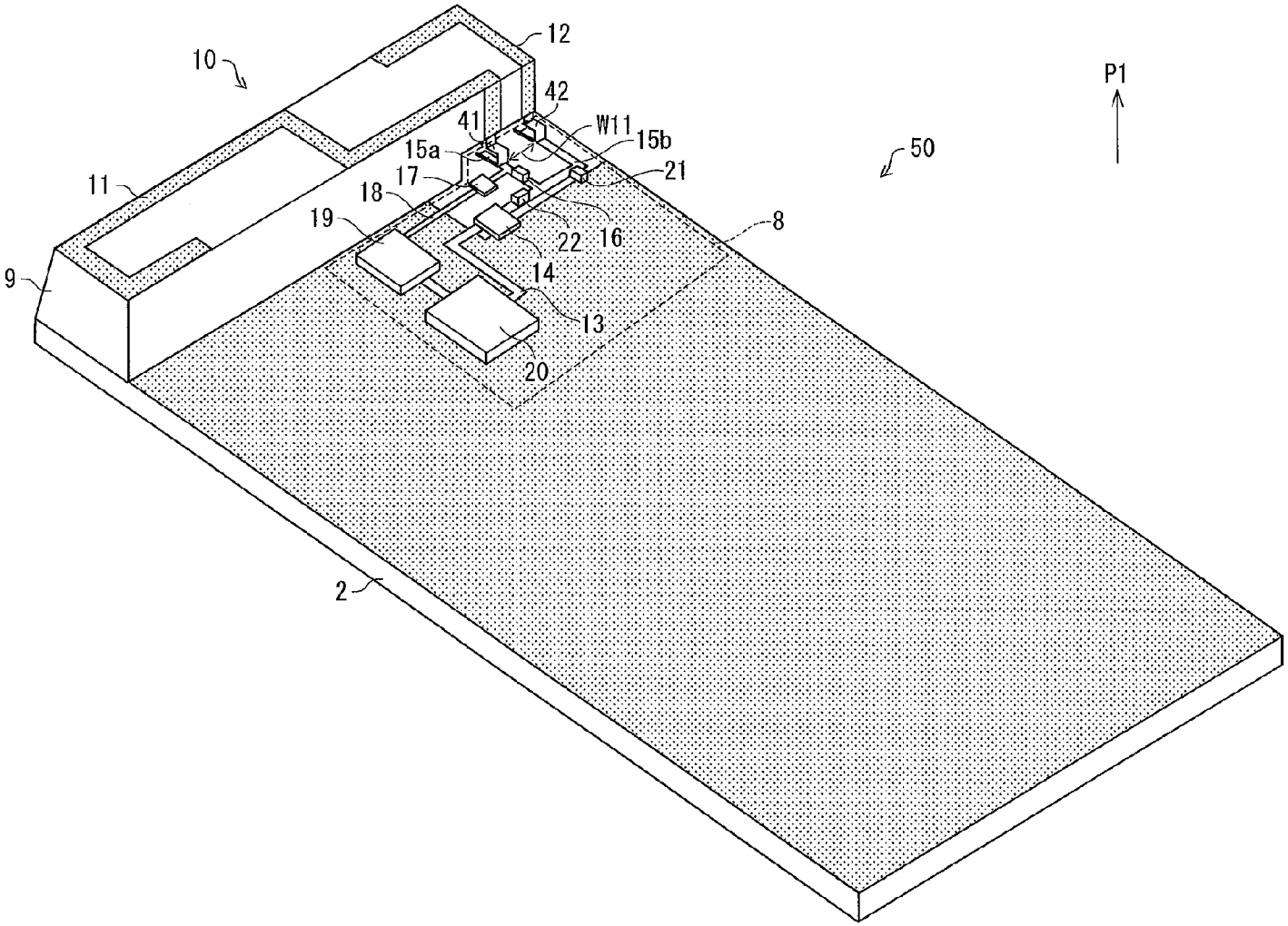
FIG. 1, which illustrates how members are arranged in an antenna device according to an embodiment of the present invention, is a perspective view in which the antenna device is seen from one direction.

Subsequently, members of the antenna device 50 are to be described with reference to FIG. 1. FIG. 1, which illustrates how the members are arranged in the antenna device 50 according to the present embodiment, is a perspective view in which the antenna device 50 is seen from one direction.

Note that, for convenience, a direction of an arrow P1 is defined as "an upward direction". Note also that, in the drawings subsequent to FIG. 1, members having functions identical to those of the respective members illustrated in FIG. 1 are given respective identical reference numerals, and a description of those members is omitted there, unless otherwise noted.

First, how the members of the antenna device 50 are arranged is to be described with reference to FIG. 1. The antenna device 50 includes the antenna section 10 and the circuit board 2 (see FIG. 1).

The antenna section 10 includes an antenna base 9 and antenna elements (a first antenna element and a second antenna element) 11 and 12.

The antenna base 9 made of a dielectric material is provided on an end of the circuit board 2, and the antenna elements 11 and 12 for transmitting/receiving a radio wave are provided on a surface of the antenna base 9 (see FIG. 1).

The circuit board 2 is a board which includes the antenna control section 8 for controlling the antenna section 10. Note that the circuit board 2 can be provided with a circuit for realizing the various functions of the mobile phone 1.

The antenna control section 8 includes antenna connecting sections (connecting parts) 41 and 42 serving as plate spring terminals for connecting the antenna control section 8 to the respective antenna elements 11 and 12.

The antenna elements 11 and 12 are made of a plate electroconductive member. Lines of the respective antenna elements 11 and 12 extend upward along a side surface of the antenna base 9 from connecting parts of the lines and the respective antenna connecting sections 41 and 42 and then reach a top surface of the antenna base 9, on which the lines respectively extend while being bent. Note that examples of a shape, a length, a width, the number of bends, and the like of the antenna, each of which can be appropriately changed, are to be specifically described later.

Assuming that a resonance frequency of the antenna element 11 is denoted as f and a wavelength to f is denoted as $\lambda$, a distance W11 between the antenna connecting sections 41 and 42 is less than $\lambda/15$ which is one-fifteenth of $\lambda$ where an electrical length of the antenna element 11 is $\lambda/4$.

For example, the present embodiment is arranged such that the antenna element 11 has a longer line length than the antenna element 12. According to this, the antenna element 11 has a longer electrical length than the antenna element 12.

(Circuit Configuration of Antenna Control Section)

Figure 4:
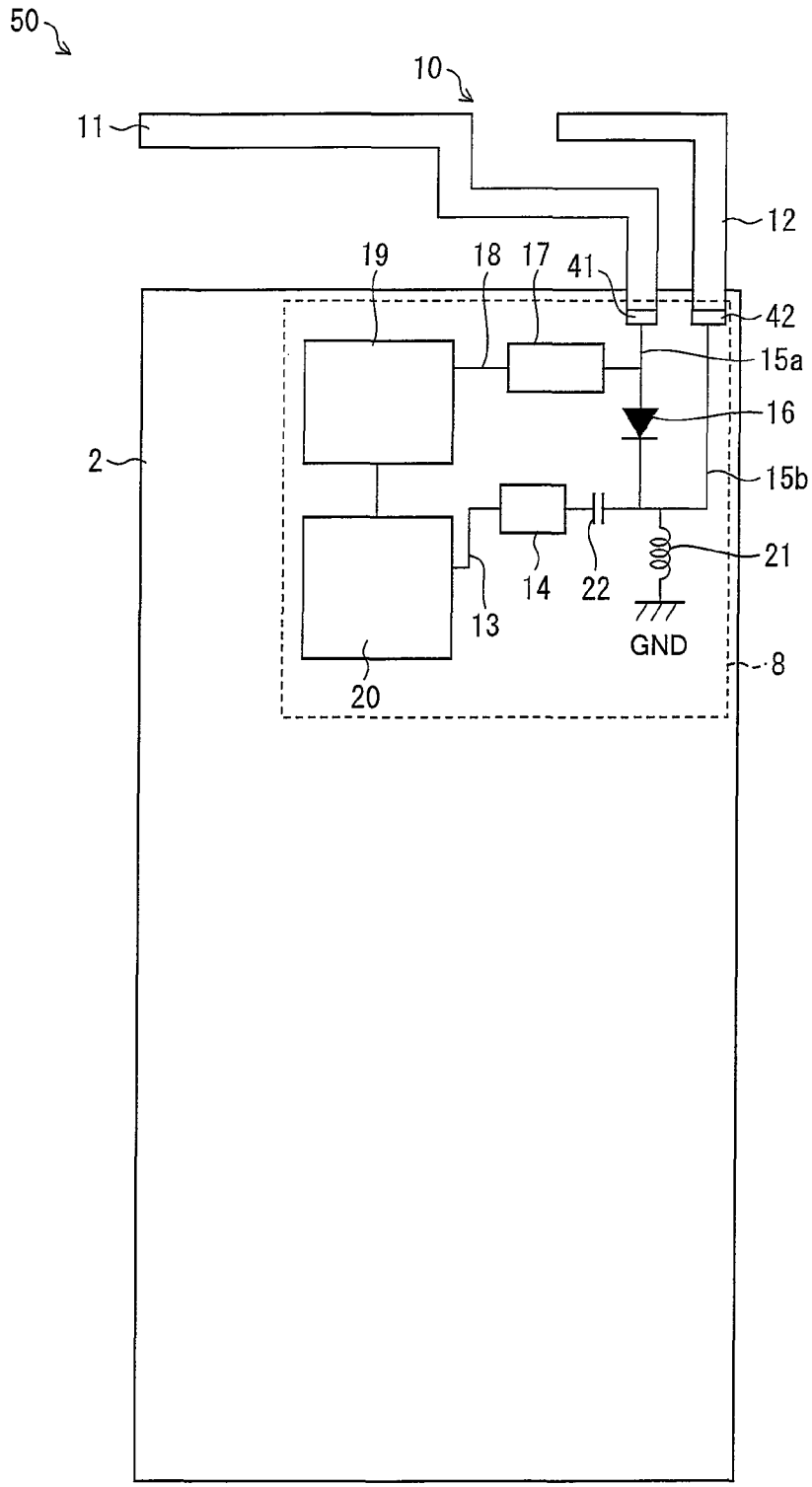
FIG. 4 is a schematic view schematically illustrating a circuit configuration of an antenna control section according to the embodiment of the present invention.

Next, a circuit configuration of the antenna control section 8 is to be described with reference to FIG. 4. FIG. 4 is a schematic view schematically illustrating the circuit configuration of the antenna control section 8.

The antenna control section 8 includes a power supply line 13, a matching circuit (an impedance matching circuit) 14, power supply connecting sections (the first power supply path and the second power supply path) 15*a* and 15*b*, a PIN diode (a switching element or a semiconductor element) 16, a diode control circuit 17, a signal line 18, the control section 19, the wireless section (power supply section) 20, a choke coil 21, a DC cut 22, and the antenna connecting sections 41 and 42.

The antenna element 11 is connected to the antenna connecting section 41 in the antenna control section 8 (see FIG. 4). The antenna connecting section 41 is connected to the power supply connecting section 15*a*.

The power supply line 13 has (i) one end to which the power supply connecting section 15*a* is connected via the DC cut 22 and the matching circuit 14 and (ii) the other end which is connected to the wireless section 20 so as to transmit, to the antenna element 11, a high-frequency current supplied from the wireless section 20. Note that the DC cut 22, which is provided so as to prevent a direct current from entering the wireless section 20 and transmissively supplies a high-frequency current, has no influence on a high-frequency characteristic of the antenna control section 8.

The PIN diode 16 is provided between the antenna connecting section 41 and the DC cut 22. A control voltage supplied from the diode control circuit 17 which is connected between the antenna connecting section 41 and the PIN diode 16 changes on/off states of the PIN diode 16.

The antenna element 12 is connected to the antenna connecting section 42. The antenna connecting section 42 is connected to the power supply connecting section 15*b*.

The power supply connecting section 15*b* is connected to the power supply line 13 via the DC cut 22 and the matching circuit 14. The choke coil 21 is connected to the power supply connecting section 15*b* so that the PIN diode 16 has an electric potential difference. Note that the choke coil 21, which does not supply a high-frequency current of not less than a specified frequency, has no influence on a high-frequency characteristic of a circuit of the antenna element 11.

The wireless section 20 is connected to the control section 19. The control section 19 and the diode control circuit 17 are connected via the signal line 18.

The diode control circuit 17 communicates with the control section 19 via the signal line 18.

Note that the switch section 58 illustrated in FIG. 3 includes the PIN diode 16 and the diode control circuit 17.

(Diode Control Circuit)

Figure 5:
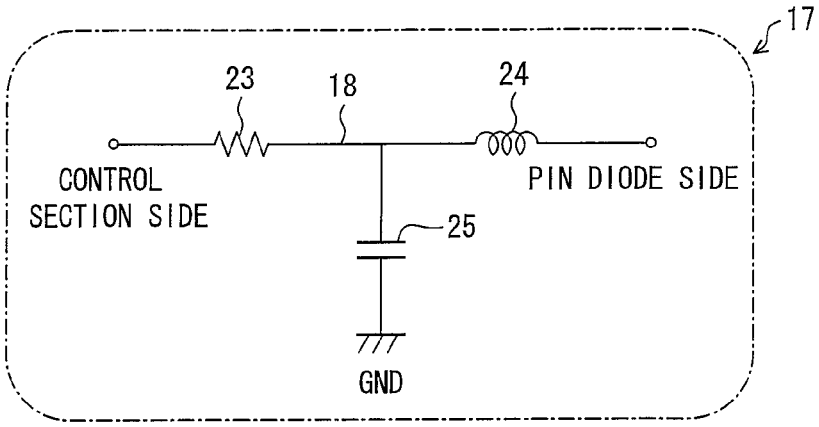
FIG. 5 is a circuit diagram illustrating a circuit configuration of a diode control circuit.

Next, the diode control circuit 17 is to be specifically described with reference to FIG. 5. FIG. 5 is a circuit diagram illustrating a circuit configuration of the diode control circuit 17.

The diode control circuit 17 includes a resistance 23 for adjusting a direct current flowing to the PIN diode 16, a choke coil 24 for interrupting a high-frequency current, and a DC cut 25 for supplying a high-frequency current to the ground. With the signal line 18, the resistance 23 and the choke coil 24 are connected in series and the DC cut 25 is connected in parallel.

Each of the choke coil 24 and the DC cut 25 prevents a high-frequency current from entering the control section 19 while supplying a direct current to the PIN diode 16.

Note that the control section 19 controls a voltage to be applied to the PIN diode 16 via the diode control circuit 17, so as to change the on/off states of the PIN diode 16.

Namely, when a forward voltage of not less than a specified value is applied to the PIN diode 16 in response to the control by the control section 19, the PIN diode 16 is turned on.

Voltages generated at both ends of the resistance 23 and a resistance of the resistance 23 can control a direct current flowing to the PIN diode 16, and an operating characteristic of the PIN diode 16 depends on an amount of the direct current flowing to the PIN diode 16. Note that the amount of the direct current flowing to the PIN diode 16 can be found based on the Ohm's law by use of the voltages generated at both ends of the resistance 23 and the resistance of the resistance 23.

In contrast, when the forward voltage of less than the specified value is applied to the PIN diode 16 in response to the control by the control section 19, the PIN diode 16 is turned off. The control section 19 can apply the forward voltage of 0V to the PIN diode 16 so as to turn off the PIN diode 16.

(Operation of Antenna Device)

Figure 6:
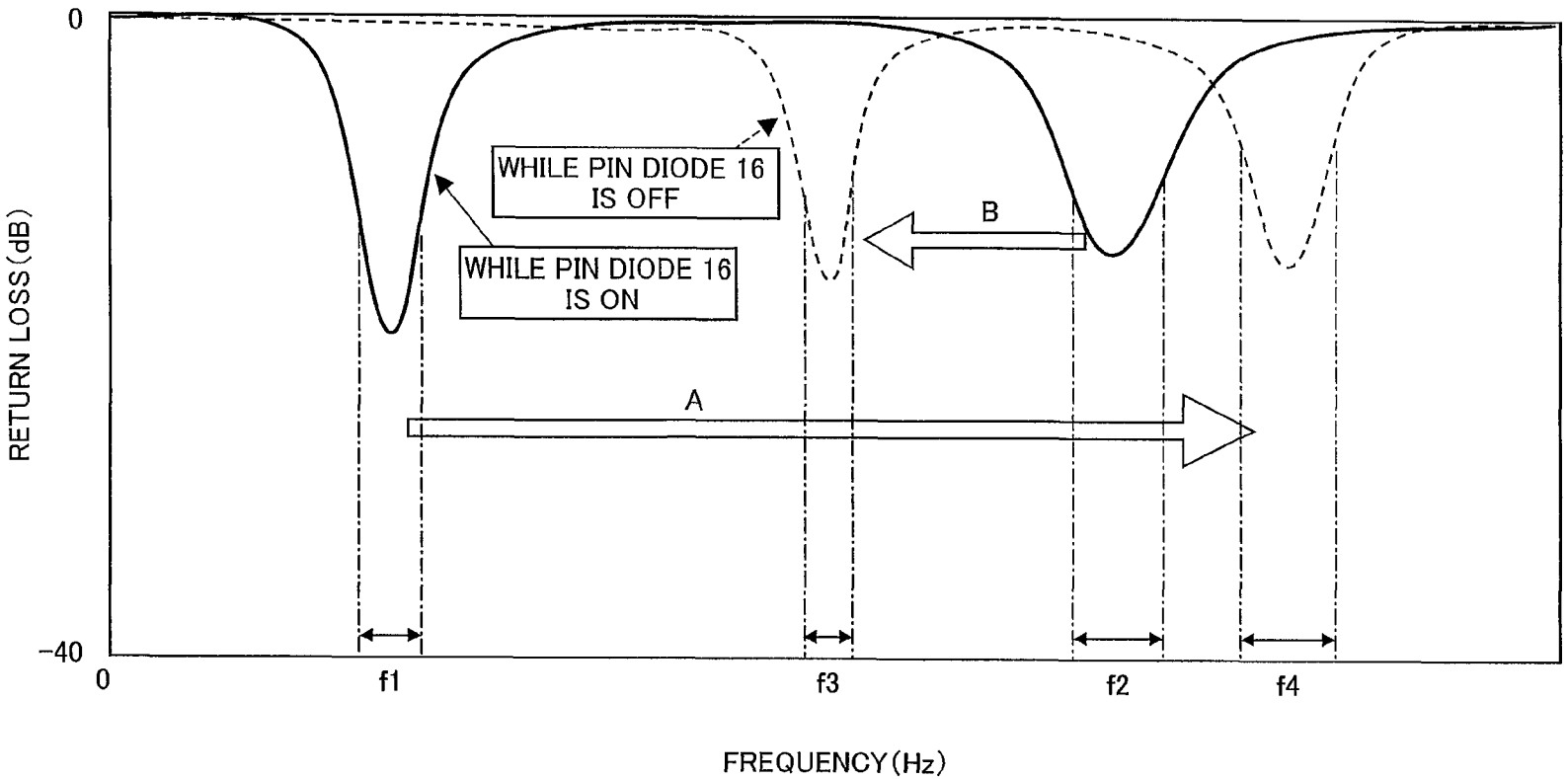
FIG. 6 is a graph schematically illustrating a return loss characteristic of the antenna device according to the embodiment of the present invention.

Subsequently, operation of the antenna device 50 is to be described referring to FIG. 6 and also referring to FIG. 4 again. FIG. 6 is a graph schematically illustrating a return loss characteristic of the antenna device 50 according to the present embodiment.

A larger radiation loss used as antenna radiation makes a return loss value smaller, and it is desirable that an antenna be designed so that the return loss value is as small as possible.

In the graph of FIG. 6, the return loss characteristic obtained while the PIN diode 16 is on is shown in a solid line, and the return loss characteristic obtained while the PIN diode 16 is off is shown in a dashed line. Depressed parts of each of the solid line and the dashed line which are illustrated in FIG. 6 refer to resonance frequencies.

The antenna device 50 according to the present embodiment obtains a plurality of resonance frequencies in each the on/off states of the PIN diode 16 (see FIG. 6).

The antenna elements 11 and 12 respectively operate at the resonance frequencies f1 and f2 while the PIN diode 16 is on (see FIG. 6).

Note that the antenna element 12, which has a shorter electrical length than the antenna element 11, resonates at f2, which is higher than f1 at which the antenna element 11 resonates (see FIG. 6).

The antenna elements 11 and 12 respectively operate at the resonance frequencies f4 and f3 while the PIN diode 16 is off (see FIG. 6).

Namely, a change in on/off states of the PIN diode 16 causes a change, from f1 to f4 (see an arrow A), in resonance frequency of the antenna element 11. Note here that f4 is substantially twice as high as f1.

In contrast, the change in on/off states of the PIN diode 16 causes a change, from f2 to f3 (see an arrow B), in resonance frequency of the antenna element 12. Note here that f3 is lower than f2.

(Principle of Operation of Antenna Element)

Next, the following description discusses, with reference to FIG. 4, a principle of operation carried out by the antenna elements 11 and 12 in each of the on/off states of the PIN diode 16.

(1: Antenna Element 11)

(i) In On State

Since the PIN diode 16 which is on serves as a resistance element having a very small resistance, the PIN diode 16 connects both ends of the power supply connecting section 15*a*, so that the antenna element 11 is connected to the power supply line 13 via the power supply connecting section 15*a*.

Therefore, a specified high-frequency current is supplied from the wireless section 20 to the antenna element 11 via the power supply line 13. This causes the antenna element 11 to operate as a ¼ wavelength antenna which resonates at f1 (Hz: hertz). Assuming that, in this case, a wavelength is λ1 (*m*), a light velocity is c (m/s) (≈3×108 (m/s)), and a total length of the antenna 11 is L1 (*m*), λ1 and L1 can be found based on the following equations (1) and (2).

$$\lambda 1 = c/f1 \quad (1)$$

$$L1 = \lambda 1/4 \quad (2)$$

The antenna element 11, which has a longer electrical length than the antenna element 12, resonates at a lower frequency than f2 at which the antenna element 12 operates (see FIG. 6).

In such a case where the antenna element 11 operates as the ¼ wavelength antenna, the antenna connecting section 41 has the highest current distribution.

(ii) In Off State

Since the PIN diode 16 which is off serves as the resistance element having a very large resistance and a very small capacitance, the PIN diode 16 causes both ends of the power supply connecting section 15*a* to be open. This causes a disconnection between the antenna element 11 and the power supply line 13.

Both ends of the antenna element 11 are opened, so that the antenna element 11 operates as a ½ wavelength antenna element and resonates at f4 where an electrical length of the antenna element 11 is λ4/2.

The antenna elements 11 and 12, which are made of a conductor, have a capacitance which is determined in accordance with an area, a distance, and a permittivity thereof. In a case where two conductors are provided in a given range, a charge exchange due to a capacitance occurs therebetween. Namely, the antenna elements 11 and 12 are capacitively coupled.

In order to cause capacity coupling, it is preferable that the distance W11 between the antenna connecting sections 41 and 42 be not more than λ1/15 which is one-fifteenth of λ1 where an electrical length of the antenna element 11 is λ1/4.

According to such an arrangement, a charge exchange due to a capacitance occurs between the antenna elements 11 and 12 while the PIN diode 16 is off. Note that a state in which the charge exchange due to the capacitance occurs between the antenna elements 11 and 12 is hereinafter referred to as "a state in which the antenna elements 11 and 12 are electrically coupled".

Electrical coupling of the antenna elements 11 and 12 causes a high-frequency current to be supplied from the wireless section 20 to the power supply connecting section 15*b*. Therefore, the antenna element 11 can receive the supplied high-frequency current through a charge exchange due to a capacitance which charge exchange occurs between the antenna connecting sections 41 and 42.

Assuming here that a wavelength to f4 is λ4, a relationship among f1, f4, λ1, and λ4 can be expressed by the following equations (3) and (4).

$$\lambda 4 = c/f4 \tag{3}$$

$$L1 = \lambda 4/2 = (2 \times \lambda 4)/4 \tag{4}$$

Note here that, since the left side of the equation (2) and the left side of the equation [4] are equal, i.e., "L1", the following equation (5) is obtained.

$$\lambda 1 = 2 \times \lambda 4 \tag{5}$$

Namely, λ4 is half a length of λ1 based on the equation (5).

Note also that the following equation (6) is obtained by applying the equation (5) to the equations (1) and (3) which have been transformed.

$$f4 = c/\lambda 4 = 2 \times c/\lambda = 2 \times f1 \tag{6}$$

Namely, f4 is the frequency which is twice as high as f1, based on the equation (6).

Actually, a relationship among these equations (1) through (6) may not exactly hold due to a slight error. Examples of the cause of the slight error include at least an influence of a length of the antenna element 12 which is electrically coupled to the antenna element 11 and an influence of the matching circuit 14 which has a frequency characteristic. Therefore, there are many cases where f4 is not exactly twice as high as f1.

(2: Antenna Element 12)

(i) In On State

As described earlier, the antenna element 12, which has a shorter electrical length than the antenna element 11, resonates at a higher frequency than f1 at which the antenna element 11 resonates (see FIG. 6).

Note that, in this case, the antenna element 12 operates as the ¼ wavelength antenna. Note also that, in such a case where the antenna element 12 operates as the ¼ wavelength antenna, the antenna connecting section 41 has the highest current distribution.

(ii) In Off State

The antenna element 12 operates as the ¼ wavelength antenna in each of the on/off states of the PIN diode 16.

However, note here that, in a case where a distance between the antenna elements 11 and 12 falls within a given range, the antenna elements 11 and 12 are electrically coupled, so as to a change in resonance frequency.

Specifically, as described earlier, the antenna elements 11 and 12 are electrically coupled, provided that the distance between the antenna connecting sections 41 and 42 falls within λ1/15.

For this reason, the electrical coupling of the antenna elements 11 and 12 causes the antenna element 12 to have a long electrical length.

As a result, the antenna element 12 resonates at f3, which is the frequency lower than f2.

(Examples of Antenna Device)

Next, the following description discusses, with reference to FIGS. 7 through 14, Examples 1 through 6 in each of which the length L1 of the antenna element 11 is fixed and a length L2 of the antenna element 12 is changed in the antenna device 50 according to the present embodiment.

Figure 7:
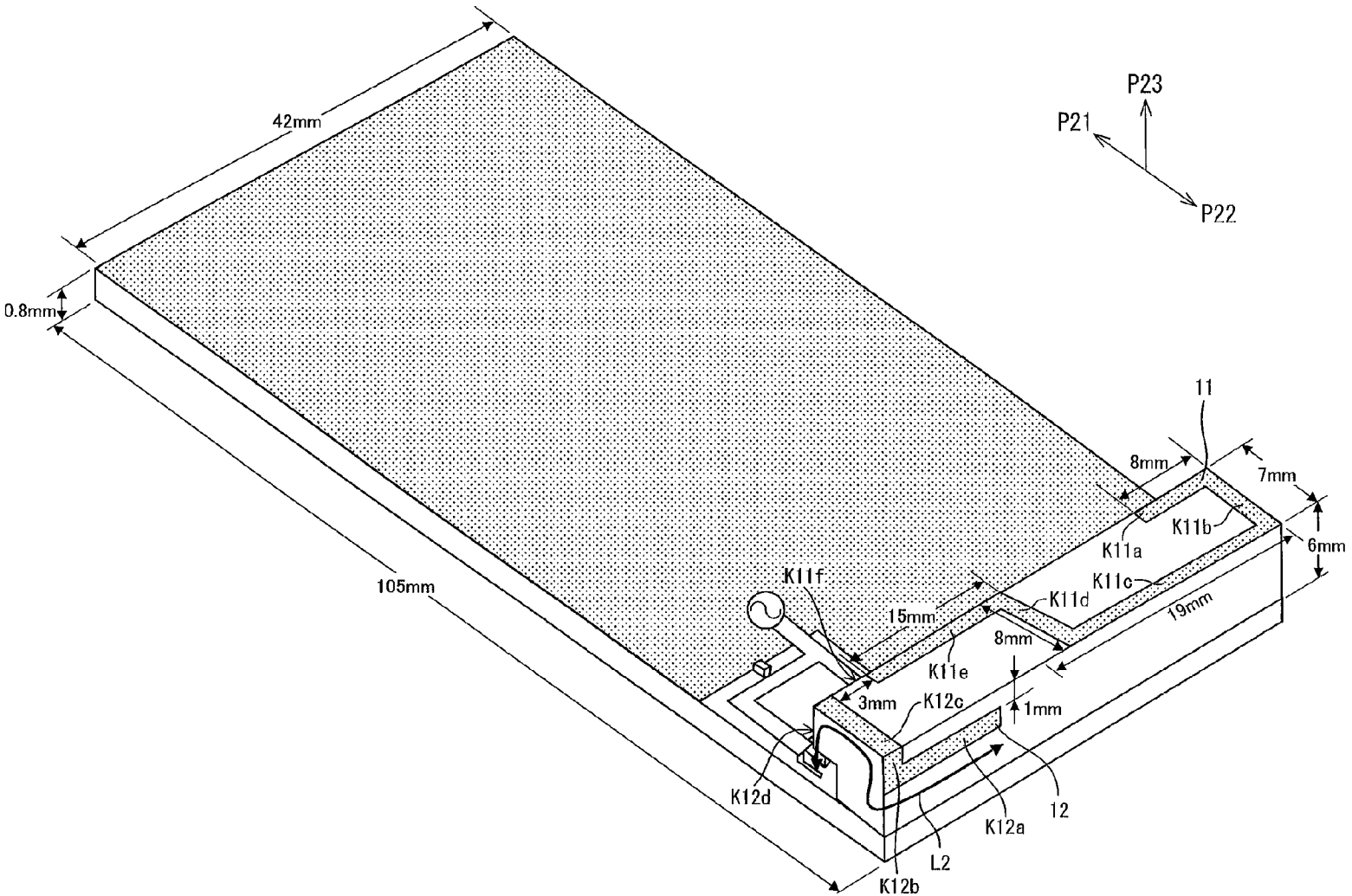
FIG. 7, which is a perspective view in which the antenna device according to the embodiment of the present invention is seen from another direction, illustrates an example of the antenna device.
Figure 8:
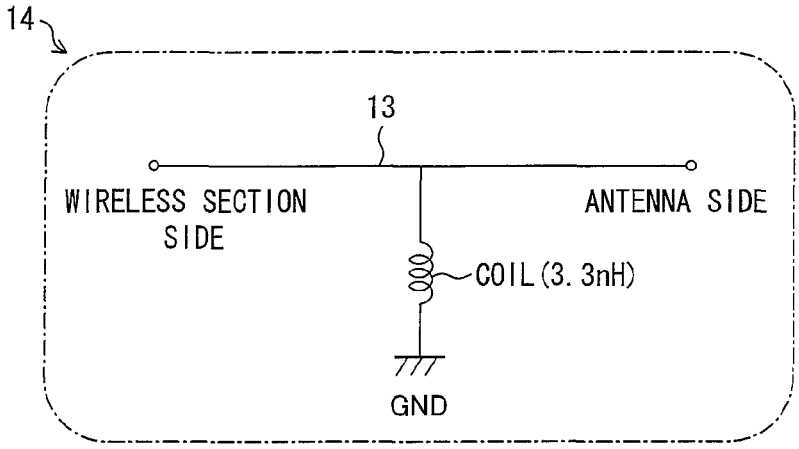
FIG. 8 is a circuit diagram illustrating an example of a circuit configuration of a matching circuit.

FIG. 7, which is a perspective view in which the antenna device 50 according to the present embodiment is seen from another direction, illustrates an example of the antenna device 50. FIG. 8 is a circuit diagram illustrating an example of a circuit configuration of the matching circuit 14. FIGS. 9 through 14 are graphs respectively illustrating return loss characteristics of the antenna device 50 according to Examples 1 through 6.

The following description discusses Examples 1 through 6, assuming that in FIG. 7, an arrow P21 represents a side of the antenna base 9 on which side a rear surface of the antenna base 9 is located, an arrow P22 represents a side of the antenna base 9 on which side a front surface of the antenna base 9 is located, and an arrow P23 represents a side of the antenna base 9 on which side the top surface of the antenna base 9 is located.

In each of Examples 1 through 6, the circuit board 2 has a thickness of 0.8 mm, a length of 105 mm in a long-side direction (in the direction of the arrow P21), and a length of 42 mm in a short-side direction (see FIG. 7). The antenna base 9 has a height of 6 mm.

Further, in each of Examples 1 through 6, the antenna element 11 has six straight-line parts K11*a* through K11*f*. The straight-line parts K11*a* through K11*f* are connected in series from the straight-line part K11*a* which is a tip of the antenna element 11 to the straight-line part K11*f* which is connected to the antenna connecting section 41 located at the base of the antenna element 11 (see FIG. 7).

The straight-line parts K11*a* through K11*f*, which are provided on the top surface of the antenna base 9, are arranged such that the straight-line parts are connected at right angles to each other, except between the straight-line part K11*d* and each of the straight-line parts K11*c* and K11*e* (see FIG. 7). Note that the straight-line part K11*d* is at an angle of substantially 120° with the respective straight-line parts K11*c* and K11*e*.

The straight-line part K11*f*, which is provided on the rear surface of the antenna base 9 but cannot be seen in FIG. 7, is arranged between the straight-line part K11*e* and the antenna connecting section 41 (not illustrated).

Lengths of the straight-line parts K11*a* through K11*f* are set to 8 mm, 7 mm, 19 mm, 8 mm, 15 mm, and 6 mm, respectively. Accordingly, the total length L1 of the antenna element 11 is found to be: L1=8+7+19+8+15+6=63 mm In contrast, the antenna element 12 has four straight-line parts K12*a* through K12*d*. The straight-line parts K12*a* through K12*d* are connected in series from the straight-line part K12*a* which is a tip of the antenna element 12 to the straight-line part K12*d* which is connected to the antenna connecting section 42 located at the base of the antenna element 12.

The straight-line part K12*d* is provided on the rear surface of the antenna base 9, i.e., between the straight-line part K12*c* and the antenna connecting section 42. The straight-line part K12*c*, which is provided on the top surface of the antenna base 9, is connected to the straight-line part K12*b* provided on the front surface of the antenna base 9.

The straight line parts K12*a* and K12*b*, which are provided on the front surface of the antenna base 9, are connected at right angles to each other so as to be L-shaped.

Lengths of the straight-line parts K12*b*, K12*c*, and K12*d* are set to 1 mm, 7 mm, and 6 mm, respectively. In each of the following Examples, a length of the straight-line part K12*a* is changed so as to adjust the length L2.

In FIG. 7, illustration of a circuit configuration of the antenna device 50 is partially omitted for convenience of layout of the drawing.

Subsequently, the circuit configuration of the matching circuit 14 is to be described with reference to FIG. 8. The matching circuit 14 includes a chip coil 28 provided in parallel with the power supply line 13 (see FIG. 8). A chip coil (3.3 nH) is used as the chip coil 28 provided in the matching circuit 14. A width of the power supply connecting sections 15*a* and 15*b* of the antenna elements 11 and 12, respectively is set to 1.5 mm. Note that the chip coil 28 can also function as the choke coil 21.

Examples are described below with reference to FIGS. 9 through 14. In each of the graphs of FIGS. 9 through 14, the return loss characteristic obtained while the PIN diode 16 is on is shown in a solid line, and the return loss characteristic obtained while the PIN diode 16 is off is shown in a dashed line.

Example 1

L2=40 mm (f1:f2≈4:5)

Example 1 is to be described with reference to FIG. 9.

L2 is adjusted to 40 mm in Example 1. Namely, the straight-line part K12*a* has a length of 26 mm. While the PIN diode 16 is on, a ratio between the resonance frequencies f1 and f2 of the antenna elements 11 and 12, respectively is approximately 4:5 (see FIG. 9).

Figure 9:
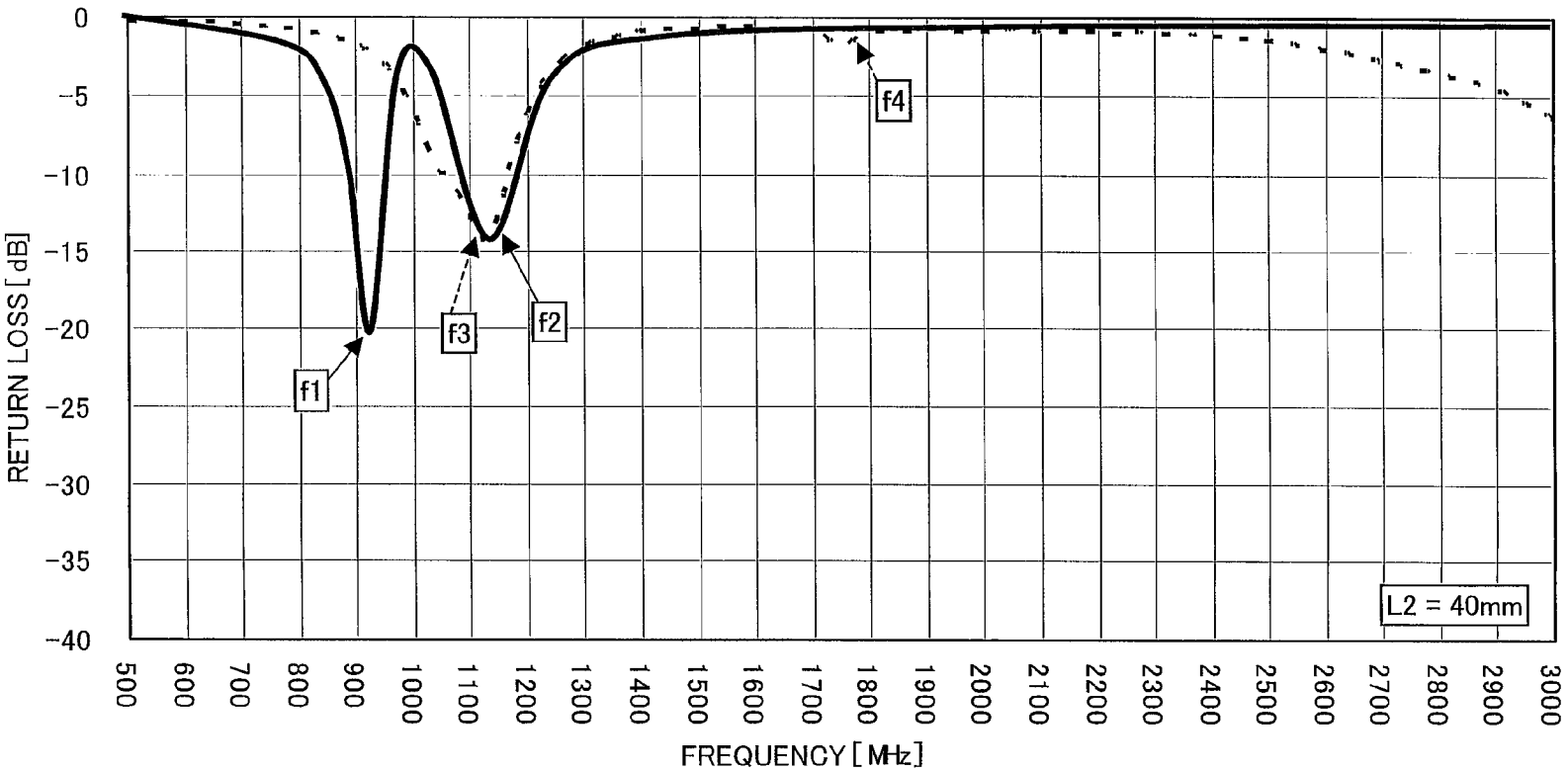
FIG. 9 is a graph illustrating a return loss characteristic of the antenna device according to Example 1.

While the PIN diode 16 is off, the resonance frequency f3 of the antenna element 12 is slightly lower than f2 (see FIG. 9). Weak resonance and a small radiation loss occur at the resonance frequency f4 of the antenna element 11, which is substantially twice as high as f1.

However, four resonance frequencies are consequently obtained by two antenna elements.

Example 2

L2=35 mm (f1:f2≈3:4)

Example 2 is to be described with reference to FIG. 10.

L2 is adjusted to 35 mm in Example 2. Namely, the straight-line part K12*a* has a length of 21 mm. While the PIN diode 16 is on, a difference between the resonance frequencies f1 and f2 of the antenna elements 11 and 12, respectively is slightly larger than that in Example 1 (see FIG. 10).

Figure 10:
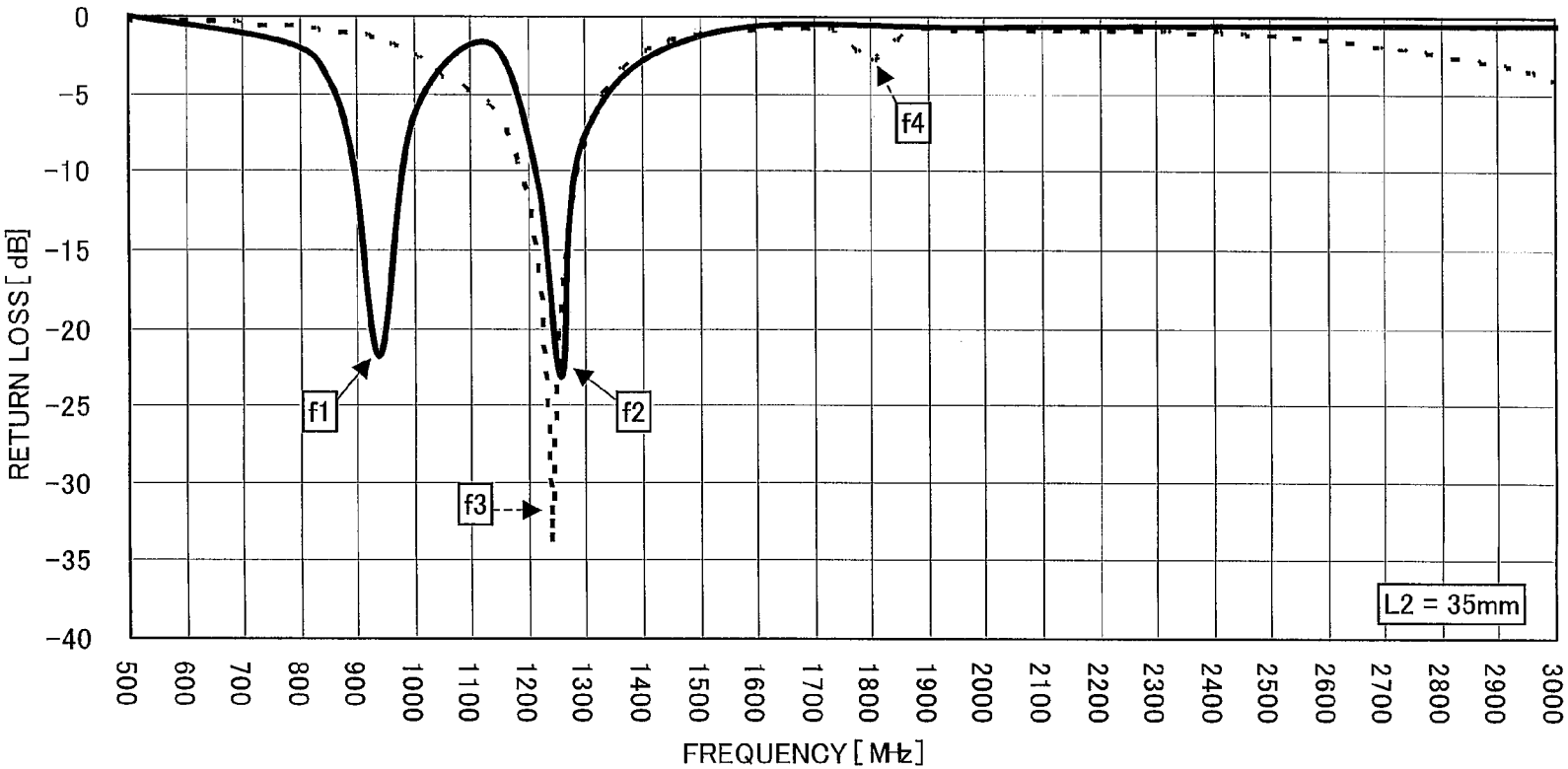
FIG. 10 is a graph illustrating a return loss characteristic of the antenna device according to Example 2.

While the PIN diode 16 is off, stronger resonance occurs at the resonance frequency f3 of the antenna element 12, which is slightly lower than f2 (see FIG. 10).

Weak resonance and a small radiation loss occur at the resonance frequency f4 of the antenna element 11, which is substantially twice as high as f1, as in the case of Example 1.

However, four resonance frequencies are consequently obtained by two antenna elements.

Example 3

L2=30 mm (f1:f2≈2:3)

Example 3 is to be described with reference to FIG. 11.

L2 is adjusted to 30 mm in Example 3. Namely, the straight-line part K12*a* has a length of 16 mm. While the PIN diode 16 is on, a difference between the resonance frequencies f1 and f2 of the antenna elements 11 and 12, respectively is further larger than those in Examples 1 and 2 (see FIG. 11).

Figure 11:
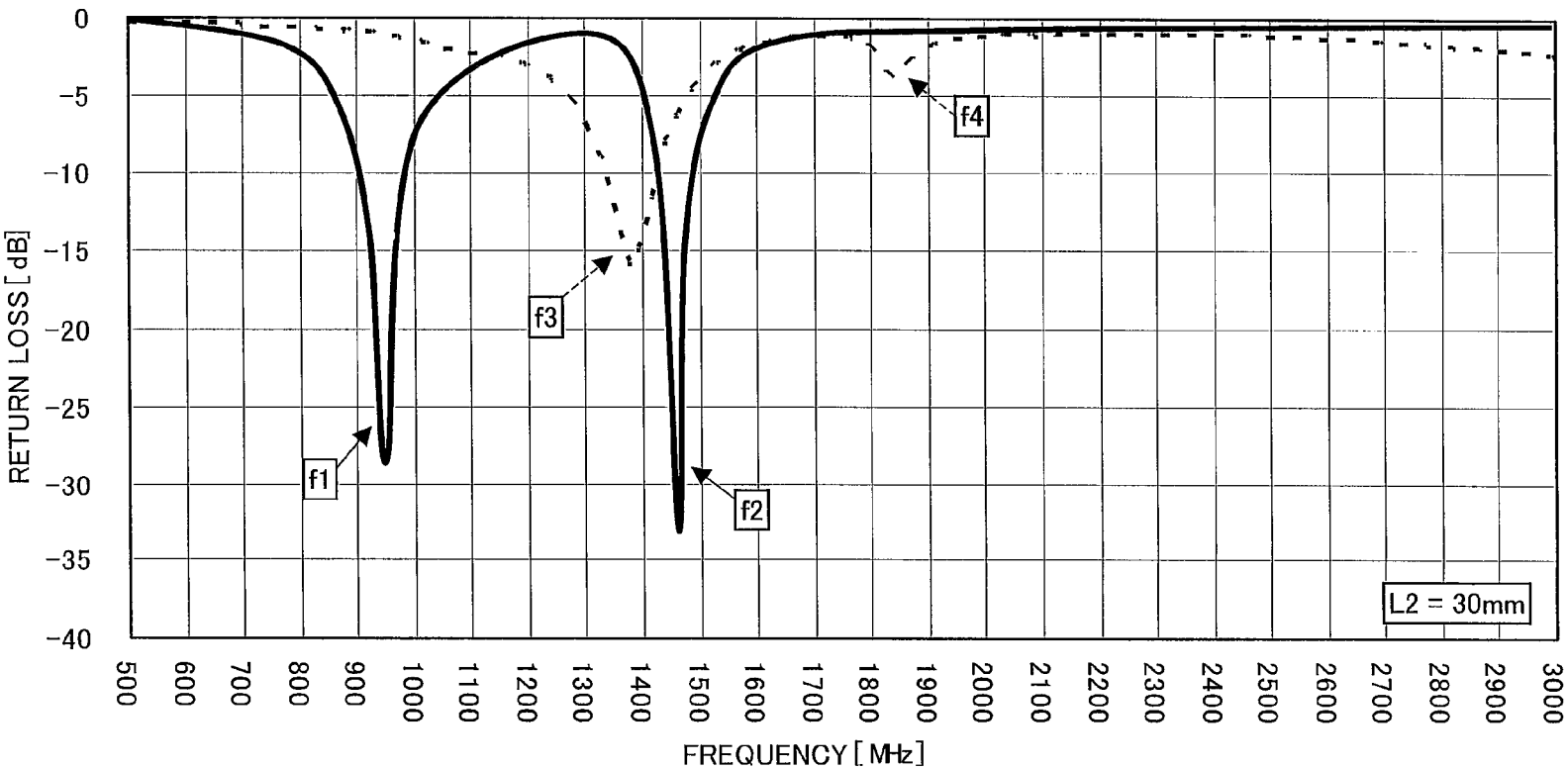
FIG. 11 is a graph illustrating a return loss characteristic of the antenna device according to Example 3.

While the PIN diode 16 is off, the resonance frequency f3 of the antenna element 12 is lower than f2 (see FIG. 11). A width in which such a change in frequency occurs is larger than those in Examples 1 and 2.

Weak resonance and a small radiation loss occur at the resonance frequency f4 of the antenna element 11, which is substantially twice as high as f1, as in the case of Examples 1 and 2.

However, four resonance frequencies are consequently obtained by two antenna elements.

Example 4

L2=25 mm (f1:f2≈1:2)

Example 4 is to be described with reference to FIG. 12.

L2 is adjusted to 25 mm in Example 4. Namely, the straight-line part K12*a* has a length of 11 mm. While the PIN diode 16 is on, a ratio between the resonance frequencies f1 and f2 of the antenna elements 11 and 12, respectively is approximately 1:2 (see FIG. 12).

Figure 12:
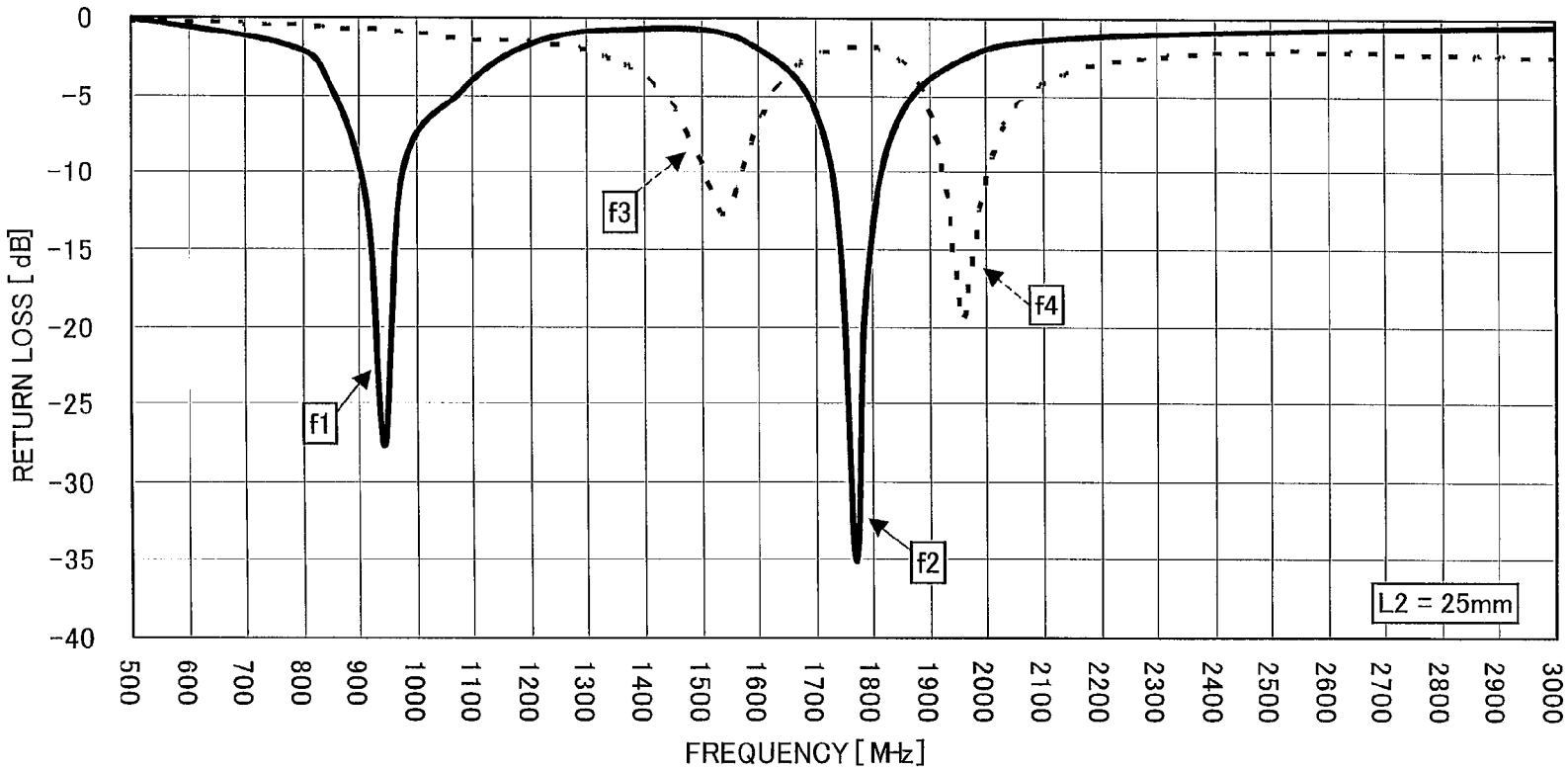
FIG. 12 is a graph illustrating a return loss characteristic of the antenna device according to Example 4.

A difference between (i) the resonance frequency f3 of the antenna element 12 which resonance frequency is obtained while the PIN diode 16 is off and (ii) f2 is larger than those in Examples 1 through 3 (see FIG. 12).

Since at f4, stronger resonance occurs and a better return loss characteristic is obtained as compared to the cases of Examples 1 through 3, a large radiation loss occurs.

In Example 4, four resonance frequencies are obtained by two antenna elements, and a preferable antenna characteristic is also obtained.

Example 5

L2=20 mm (f1:f2≈5:11)

Example 5 is to be described with reference to FIG. 13.

L2 is adjusted to 20 mm in Example 5. Namely, the straight-line part K12*a* has a length of 6 mm. While the PIN diode 16 is on, a difference between the frequencies f1 and f2 of the antenna elements 11 and 12, respectively is larger than that in Example 4 (see FIG. 13).

Figure 13:
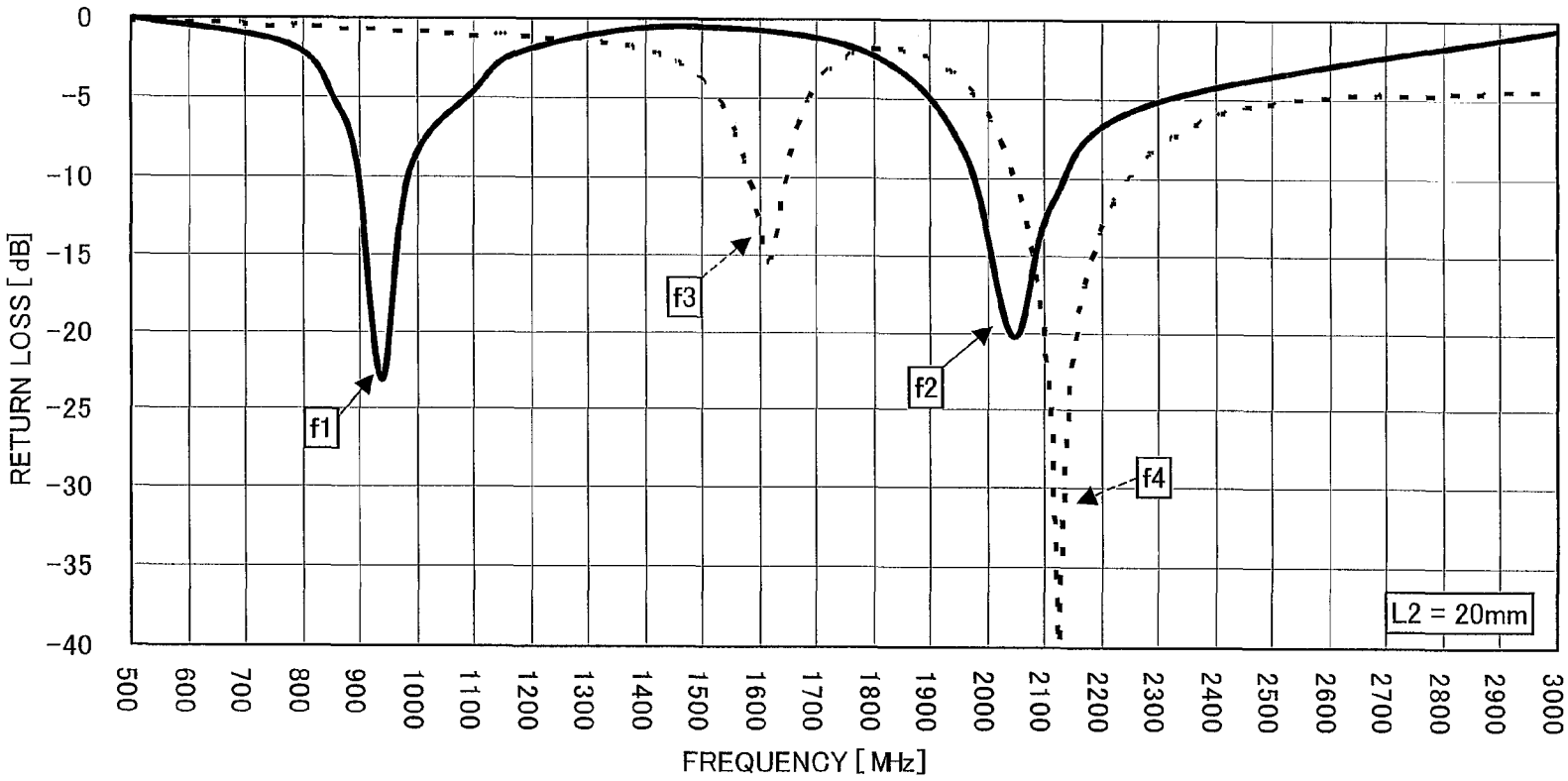
FIG. 13 is a graph illustrating a return loss characteristic of the antenna device according to Example 5.

A difference between (i) the resonance frequency f3 of the antenna element 12 which resonance frequency is obtained while the PIN diode 16 is off and (ii) f2 is larger than that in Example 4 (see FIG. 13).

Since at the resonance frequency f4 of the antenna element 11, which is substantially twice as high as f1, stronger resonance occurs and a better return loss characteristic is obtained as compared to the case of Example 4, a large radiation loss occurs.

In Example 5, four resonance frequencies are obtained by two antenna elements, and a preferable antenna characteristic is also obtained, as described earlier.

Example 6

L2=15 mm (f1:f2≈1:3)

Figure 14:
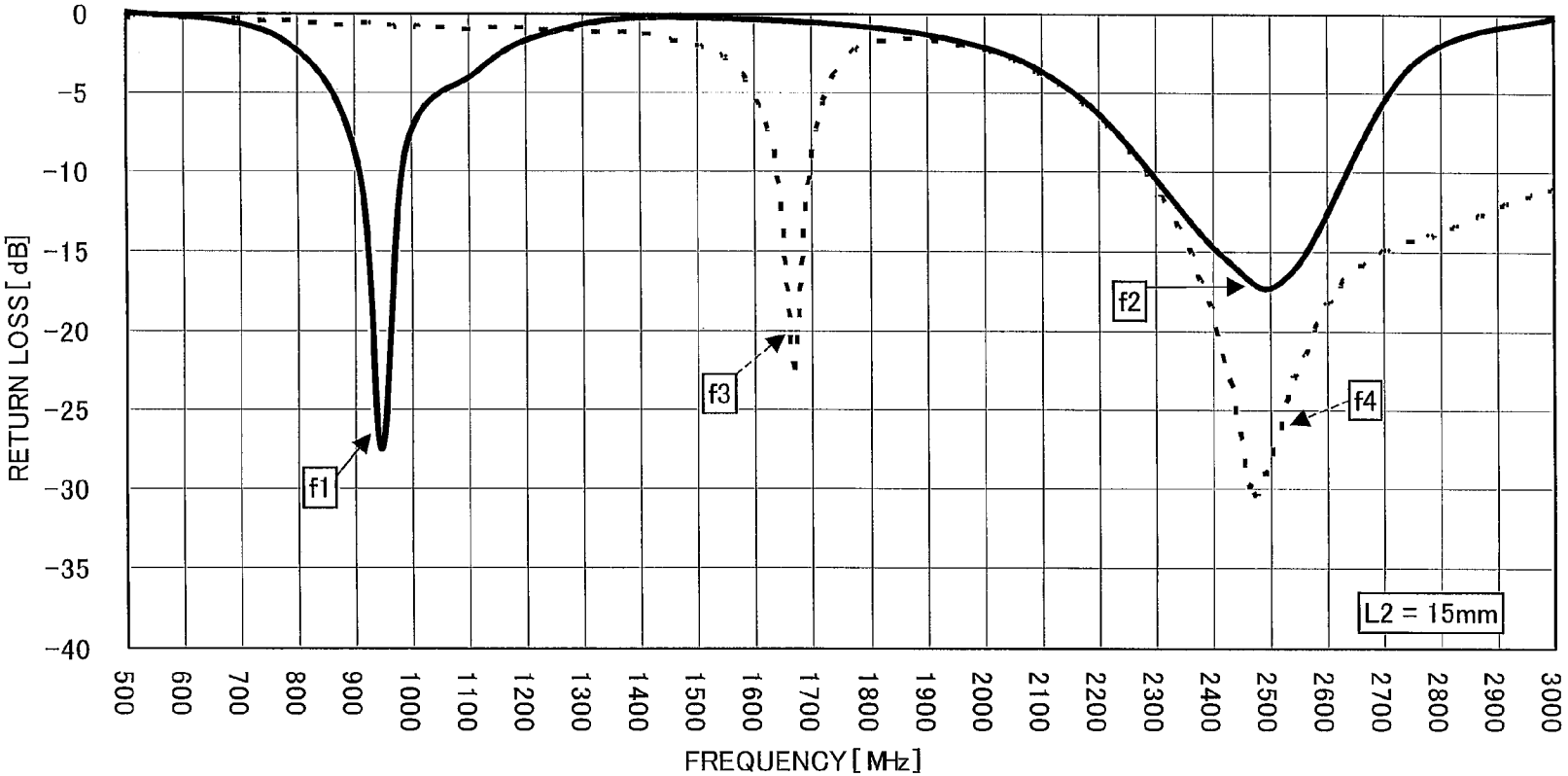
FIG. 14 is a graph illustrating a return loss characteristic of the antenna device according to Example 6.

Example 6 is to be described with reference to FIG. 14.

L2 is adjusted to 15 mm in Example 6. Namely, the straight-line part K12*a* has a length of 1 mm. While the PIN diode 16 is on, a difference between the resonance frequencies f1 and f2 of the antenna elements 11 and 12, respectively is larger than those in Examples 1 through 5 (see FIG. 14).

The resonance frequency f4 of the antenna element 11 which resonance frequency is obtained while the PIN diode 16 is off and f2 are in a substantially equivalent band. At f4, resonance occurs in a broader frequency band and a better return loss characteristic is obtained than at f2.

In contrast, the resonance frequency f3 of the antenna element 12 is much lower than f2.

In Example 6, four resonance frequencies are obtained by two antenna elements, and a preferable antenna characteristic is also obtained, as described earlier.

(Summary of Examples 1 Through 6)

According to the above consideration of the Examples, it is likely that a better return loss characteristic can be obtained in a case where f1 is substantially half as high as f2 and the PIN diode 16 is off.

(Further Consideration)

Next, an arrangement in which the antenna connecting sections 41 and 42 are spaced is to be considered with reference to FIGS. 15 through 18 and in view of the arrangement of Example 4 in which a preferable return loss characteristic was obtained in the above consideration.

Consideration Example

Figure 15:
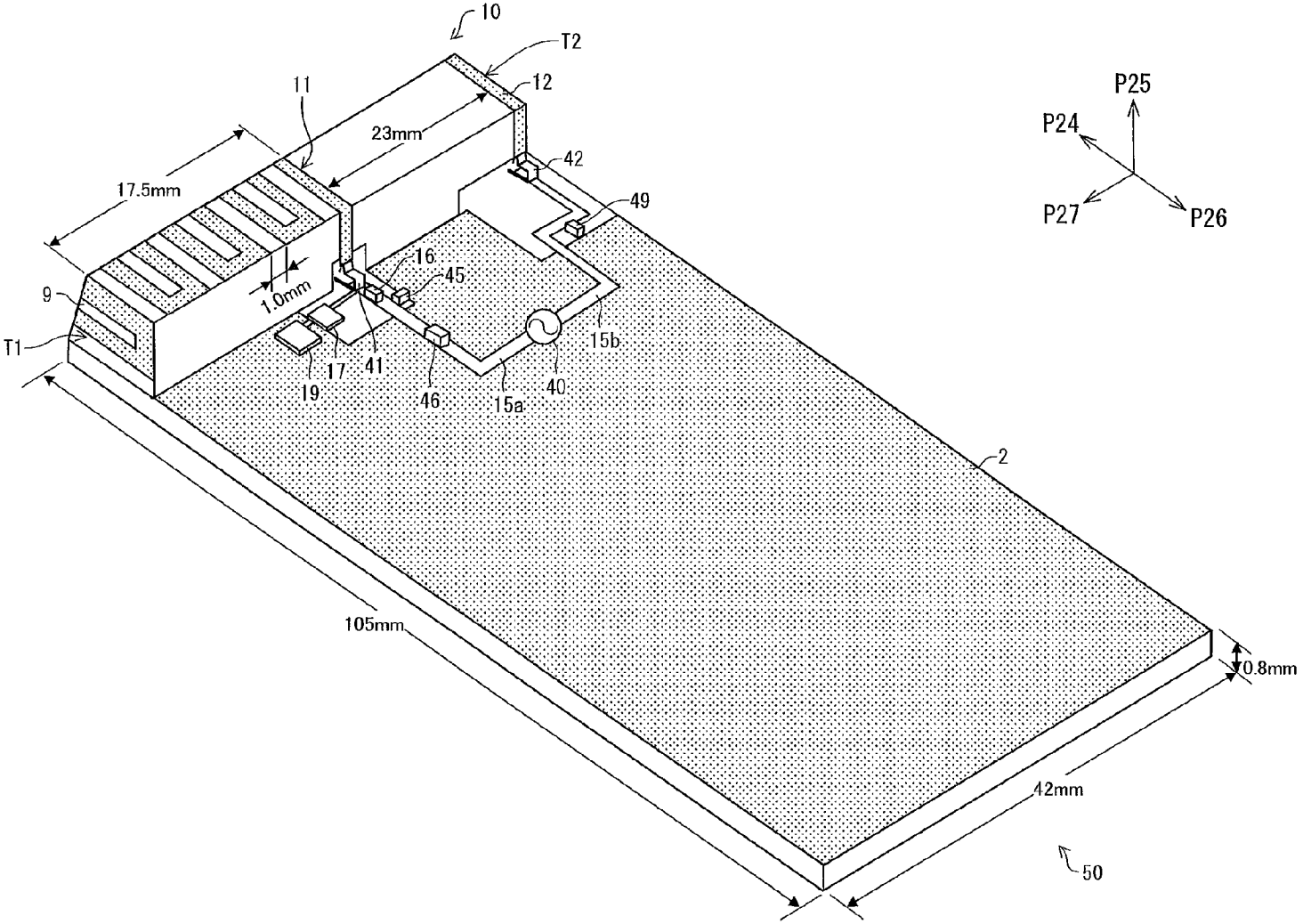
FIG. 15, which is a perspective view in which the antenna device according to the embodiment of the present invention is seen from a first direction, illustrates a consideration example of the antenna device.
Figure 16:
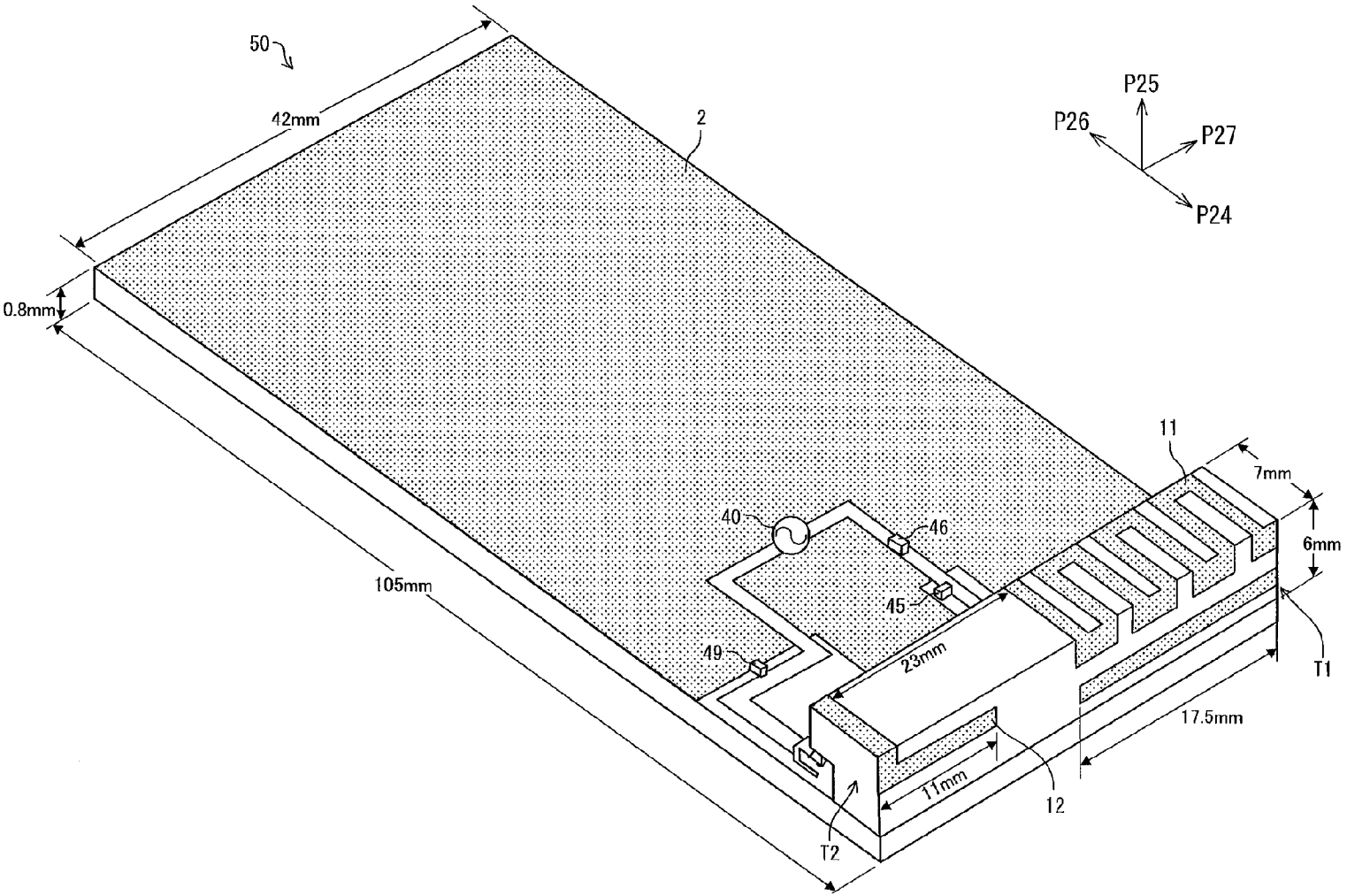
FIG. 16, which is a perspective view in which the antenna device according to the embodiment of the present invention is seen from a second direction, illustrates a consideration example of the antenna device.

First, an antenna device 50 to be considered as Consideration Example 1 is described below with reference to FIGS. 15 and 16. FIGS. 15 and 16 are perspective views in which the antenna device 50 according to the present consideration example is seen from different directions.

The antenna device 50 according to Consideration Example 1 is arranged such that (i) antenna connecting sections 41 and 42 are more spaced than those of Example 4 and (ii) as in the case of the arrangement of Example 4, patterns and matching of antenna elements 11 and 12 are appropriately adjusted so that a ratio between resonance frequencies f1 and f2 of the antenna elements 11 and 12, respectively is approximately 1:2 while a PIN diode 16 is on (see FIGS. 15 and 16).

The antenna device 50 includes an AC source 40 (see FIGS. 15 and 16). The AC source 40 has a function which is similar to that of the wireless section 20 of the antenna device 50 illustrated in FIG. 1.

The AC source 40 is connected to the antenna connecting section 41 via a power supply connecting section 15*a* and to the antenna connecting section 42 via a power supply connecting section 15*b* (see FIGS. 15 and 16). A chip coil 45 for matching (3.3 nH) and a DC cut 46 (1000 pF) are provided in the vicinity of the PIN diode 16. Note here that the chip coil 45 also serves as a choke coil for supplying a direct current. Note also that a chip coil (3.3 nH) is used as a chip coil 49 for matching provided for the antenna connecting section 42.

Note here that a point of difference and similarity in arrangement between the antenna section 10 of Example 4 and an antenna section 10 of the present consideration example is specifically described below.

Note that, for convenience, one end of an antenna base 9 at which end the antenna connecting section 42 is provided is referred to as a T2 end and the other end of the antenna base 9 is referred to as a T1 end. Assuming that an arrow P25 represents a side of the antenna base 9 on which side a top surface of the antenna base 9 is located and an arrow P24 represents a side of the antenna base 9 on which side a back surface of the antenna base 9 is located, the point of difference and similarity is described below with reference to FIGS. 15 and 16.

First, there is no change in width of the antenna elements 11 and 12, which is 1.5 mm.

There is also no change from Example 4 in shape and length L2 of the antenna element 12 and in location of the antenna connecting section 42.

In contrast, the arrangement according to the present consideration example is such that a distance between the antenna connecting sections 41 and 42 is larger to 23 mm from 3 mm of the distance of Example 4.

Namely, the antenna connecting section 41 of the present consideration example is provided closer to the T1 end than that of Example 4. Such a change in location shortens a distance between the antenna connecting section 41 and the T1 end. The distance between the antenna connecting section 41 and the T1 end is 17.5 mm.

Therefore, according to the present consideration example, a shape of the antenna element 11 is changed as described below, so as to secure (i) a length of the antenna element 11 which length is as long as the shortened distance between the antenna connecting section 41 and the T1 end and (ii) an electrical length of the antenna element 11.

Namely, according to the present consideration example, the antenna element 11 extends from an upper part of the antenna connecting section 41 to the T1 end in a direction of an arrow P27 so as to be zigzagged on the top surface of the antenna base 9, and the antenna element 11 is folded at the T1 end so as to be U-shaped and further extends from the T1 end to the back surface of the antenna base 9.

In other words, in the antenna base 9, antenna patterns of the antenna element 11 are provided closer to the T1 end than the antenna connecting section 41.

More specifically, all folded parts of the zigzag of the antenna element 11 are at right angles on the top surface of the antenna base 9, and a gap between the respective antenna patterns is 1 mm. Note that the zigzag is folded at 6 mm from the top surface of the antenna base 9 at the T1 end of the antenna base 9. The antenna element 11 which extends from the T1 end on the back surface of the antenna base 9 has a length of 17.5 mm.

Next, a return loss characteristic of the antenna device 50 according to Consideration Example 1 is described below with reference to FIG. 17.

Figure 17:
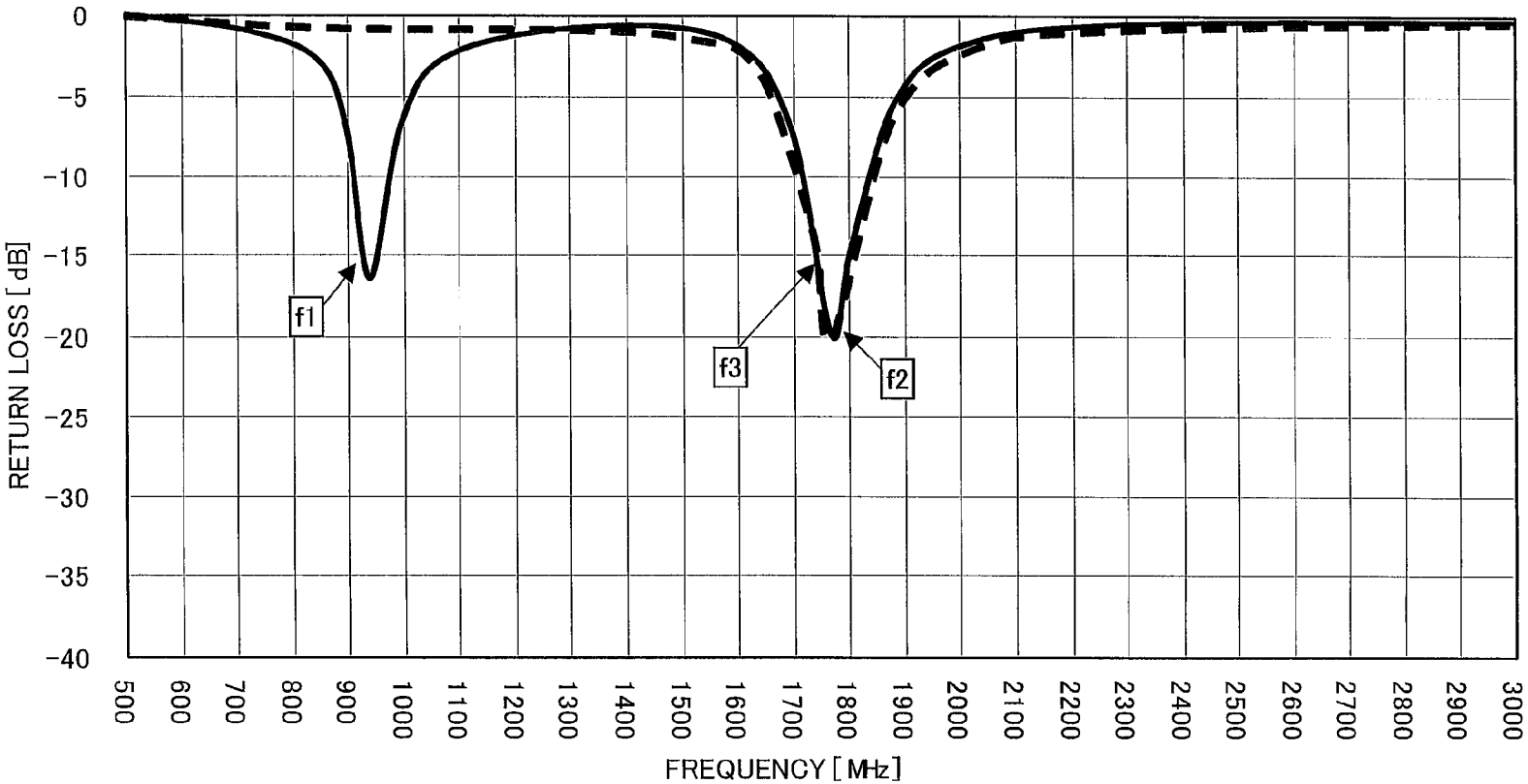
FIG. 17 is a graph illustrating a return loss characteristic of the antenna device according to Consideration Example 1.

As described earlier, while the PIN diode 16 is on, a ratio between the resonance frequencies f1 and f2 of the antenna elements 11 and 12, respectively is approximately 1:2 (see FIG. 17).

Note here that, while the PIN diode is off, a resonance frequency f3 of the antenna element 12 is almost unchanged from f2. Note that, in this case, no resonance frequency band of the antenna element 11 occurs. Namely, the resonance frequency f4 of the antenna element 11 which resonance frequency is shown in FIG. 12 does not appear in the graph illustrated in FIG. 17.

Since f1 is substantially 930 MHz, a wavelength λ1 obtained at f1 is approximately 323 mm. The distance between the antenna connecting sections 41 and 42, which is 23 mm, is slightly larger than λ1/15≈21.5 mm.

According to this, in a case where in the antenna base 9, the antenna patterns of the antenna element 11 are provided closer to the T1 end than the antenna connecting section 41, it is preferable that the distance between the antenna connecting sections 41 and 42 be not more than λ1/15 so that the antenna elements 11 and 12 are electrically coupled.

Consideration Example 2

Figure 18:
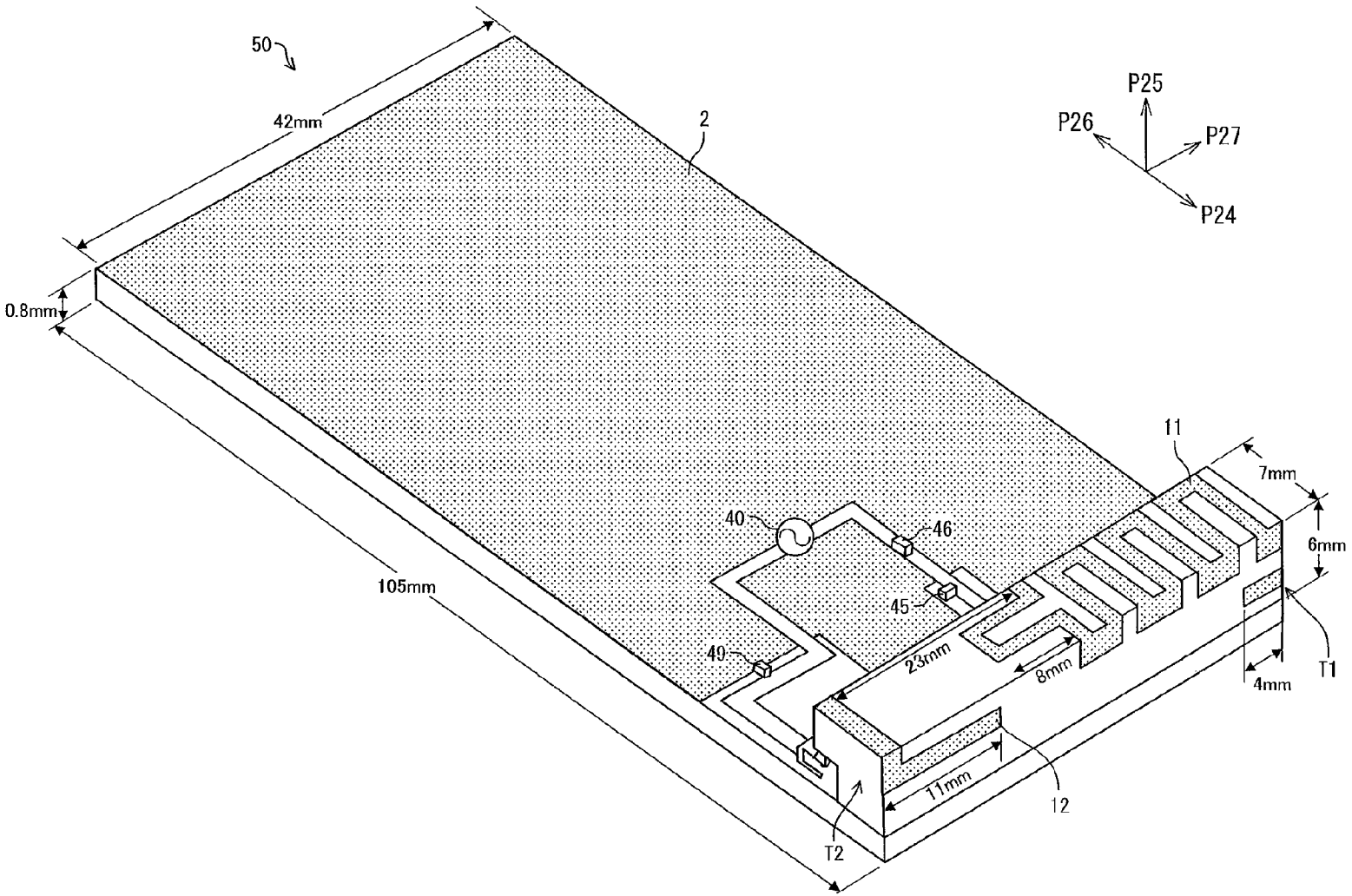
FIG. 18, which is a perspective view in which the antenna device according to the embodiment of the present invention is seen from one direction, illustrates a consideration example of the antenna device.

An antenna device 50 to be considered as Consideration Example 2 is described below with reference to FIG. 18. FIG. 18 is a perspective view illustrating the antenna device 50 according to the present consideration example.

An antenna element 11 of the antenna device 50 according to Consideration Example 2 is arranged such that, for the antenna device 50 according to Consideration Example 1, the patterns of the antenna element 11 protrude toward the T2 end on the top surface of the antenna base 9 and the antenna element 11 has a shorter length on the back surface of the antenna base 9 (see FIG. 18).

More specifically, the patterns of the antenna element 11 protrude by 8 mm toward the T2 end on the top surface of the antenna base 9. Note that the antenna element 11 has a changed length of 4 mm on the back surface of the antenna base 9.

The arrangement according to the present consideration example allows obtainment of resonance frequencies f3 and f4 while the PIN diode is off. As described above, a shape in which the patterns of the antenna element 11 protrude toward the T2 end on the top surface of the antenna base 9 may allow obtainment of the resonance frequencies f3 and f4.

Consideration Example 3

A modification of an arrangement of the antenna device 50 is to be further considered in which arrangement a distance between antenna connecting elements 41 and 42 is more than λ1/15 and antenna patterns of an antenna element 11 are arranged to be closer to a T1 end than the antenna connecting section 41 in an antenna base 9.

According to the antenna device 50 thus arranged, in a case where a tip of an antenna element 12 is extended so that the antenna element 12 is wired closer to the antenna element 11 than in the cases of Consideration Examples 1 and 2, resonance frequencies f3 and f4 may be obtained while a PIN diode 16 is off.

Namely, though the antenna device 50 according to the present consideration example is arranged such that a ratio between f1 and f2 is less than 1:2 while the PIN diode 16 is on, such an arrangement may allow obtainment of the resonance frequencies f3 and f4 while the PIN diode 16 is off.

According to the above consideration, it is possible to realize electrical coupling of the antenna elements 11 and 12 by appropriately adjusting a disposition, a shape, and the like of the antenna elements 11 and 12, so to cause the antenna elements 11 and 12 to be in proximity to each other to some extent.

This brings about an effect of the present invention of obtaining the resonance frequencies f3 and by the antenna elements 11 and 12 while the PIN diode 16 is off.

(Example of Application to Mobile Phone)

Figure 19:
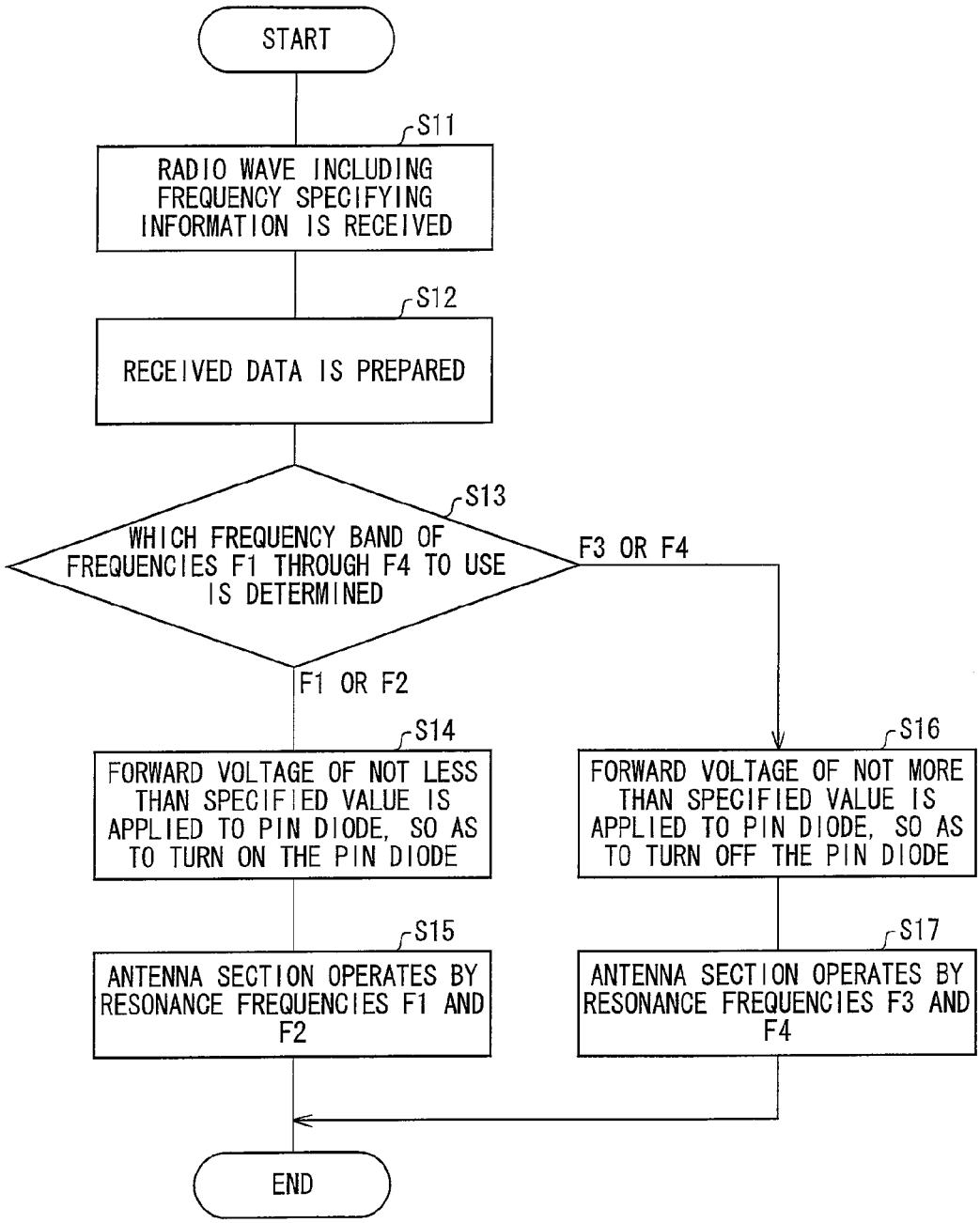
FIG. 19 is a flowchart illustrating how resonance frequencies are changed in the antenna device.

Next, the following description discusses, with reference to FIG. 19, a process flow in which such an antenna device 50 is applied to communication made by the mobile phone 1. FIG. 19 is a flowchart illustrating operation in which a resonance frequency is changed in the antenna device 50. The following description illustratively discusses how the operation is carried out when the mobile phone 1 receives a radio wave including frequency specifying information specifying that communication is carried out at a specified frequency.

Note that the frequency specifying information can be, for example, information specifying a specific frequency, provided that the information can specify a frequency band to be used. As an example, the following description assumes that any one of f1, f2, f3, and f4 illustrated in FIG. 6 is specified in the frequency specifying information.

(Process Flow)

When the antenna section 10 receives a radio wave including the frequency specifying information specifying use of any one frequency band of the frequencies f1 through f4 (S11), the wireless section 20 demodulates the received radio wave, so as to prepare received data including the frequency specifying information (S12).

The wireless section 20 transmits the prepared received data to the control section 19, so that the control section 19 determines, in accordance with the frequency specifying information included in the prepared received data, which frequency band of the frequencies f1 through f4 to use (S13).

In accordance with the determined frequency band to be used, the control section 19 notifies the wireless section 20 of information (e.g., a frequency band to be used) for duly carrying out communication and supplies a control signal to the switch section 58, so as to control the on/off states of the PIN diode 16.

Namely, in a case where the frequency band to be used is f1 or f2 ("f1 or f2" at S13), the control section 19 applies a forward voltage of not less than a specified value to the PIN diode 16, so as to turn on the PIN diode 16 (S14). This causes the antenna section 10 to operate by the resonance frequencies f1 and f2 (S15), so that the mobile phone 1 can carry out communication at the resonance frequency f1 or f2.

In contrast, in a case where the frequency band to be used is f3 or f4 ("f3 or f4" at S13), the control section 19 applies a forward voltage of not more than a specified value to the PIN diode 16, so as to turn off the PIN diode 16 (S16). This causes the antenna section 10 to operate by the resonance frequencies f3 and f4 (S17), so that the mobile phone 1 can carry out communication at the resonance frequency f3 or f4.

(Modification)

The following description discusses a modification in which the resonance frequency is preferably changed in the antenna device 50.

It is unnecessary that the frequency specifying information be included in the received radio wave. For example, the frequency specifying information can be stored in the storage section 53 so as to correspond to a specific communication application. In accordance with an application to be executed, the control section 19 can read out the frequency specifying information corresponding to the application, so as to carry out, in accordance with the read-out frequency specifying information, a communication process as illustrated in FIG. 19.

The following description illustratively discusses a case in which the control section 19 executes a GPS (global positioning system) application for specifying positional information of the mobile phone 1.

First, the operation section 57 receives, from the user, operation to start the GPS application. In response to the operation to start the GPS application, the control section 19 reads out and starts the GPS application stored in the storage section 53 and also reads out the frequency specifying information.

In this case, the control section 19 carries out the processes S13 through S17, so as to allow communication to be carried out in a specified frequency band. Thereafter, the control section 19 causes the GPS application to carry out communication and finds positional information in accordance with information obtained by the communication, so as to cause the display section 54 to display the positional information thus found and the like.

For example, the control section 19 specifies, from the read-out frequency specifying information, a frequency band in which communication is to be carried out by the GPS application. Note here that, when the frequency band to be used by the GPS application is f3, the control section 19 carries out the processes in the order of S13, S16, and S17, so as to cause the antenna section 10 to operate at the resonance frequency f3.

The antenna section 10 can be controlled so as to be in conformity with a frequency band to be used by a specific communication application, as described earlier.

Namely, it is unnecessary to start controlling the antenna section 10 after the radio wave including the frequency specifying information is received. It is possible to control the antenna section 10 so as to allow communication to be carried out in a specific frequency band, thereafter carrying out communication by starting transmission/reception of the radio wave.

Note that a communication application to be executed by the control section 19 is not limited to the GPS application and exemplified by other communication applications such as Wireless LAN (Local Area Network), television broadcasting, and Bluetooth (Registered Trademark).

Note also that not only to execute a communication application as described above but also to make a voice call or data communication, the transmission/reception of the radio wave can be started after the antenna section 10 is controlled so that communication can be carried out in a specific frequency band.

When the user presses a call starting button (not illustrated) provided in the operation section 57 of the mobile phone 1 so as to make a voice call, the control section 19 carries out communication processes as illustrated in FIG. 19, so as to start transmission/reception. When an input of a phone number by the user is detected, the control section 19 can start transmission/reception by specifying a frequency to be used for the inputted phone number so as to carry out the communication processes as illustrated in FIG. 19.

When the user presses a data obtaining button (not illustrated) provided in the operation section 57 of the mobile phone 1 so as to make data communication, the control section 19 carries out the communication processes as illustrated in FIG. 19, so as to control the antenna section 10 and then start transmission/reception.

The antenna device 50 is applicable not only to the mobile phone 1 but also to a device for carrying out other wireless communication, i.e., a wireless terminal. Specifically, the antenna device 50 is applicable to a personal computer, a base station, a PDA (Personal Digital Assistant), a game machine, and the like.

(Conformity with Communication System)

Next, Examples are to be described in each of which the antenna device 50 according to the present embodiment is in conformity with each communication system. Namely, the following description discusses Examples in each of which the antenna device 50 is in conformity with frequency bands for use in wireless communication systems.

Example 7

Figure 20:
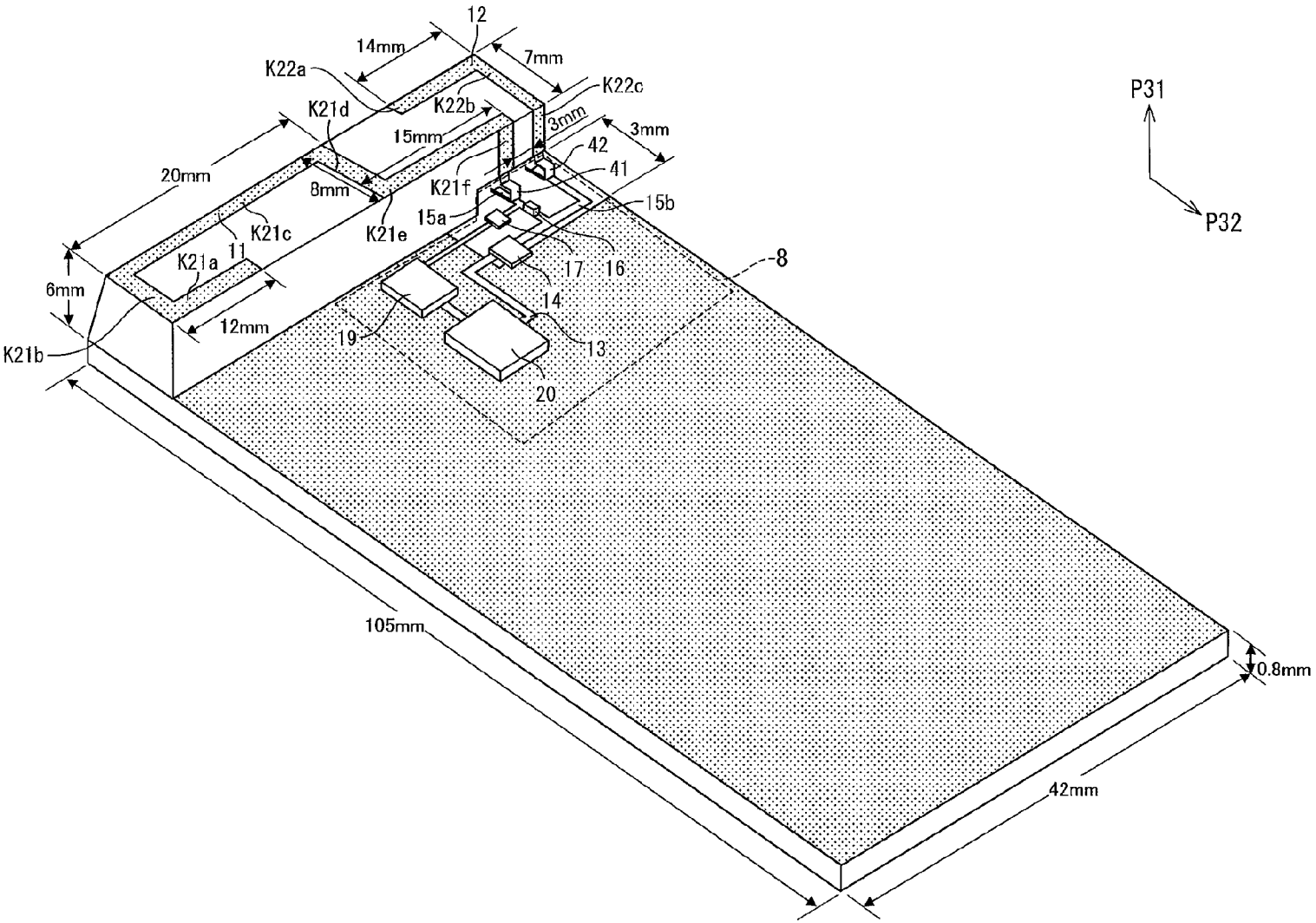
FIG. 20 is a perspective view illustrating another example of the antenna device according to the embodiment of the present invention.
Figure 21:
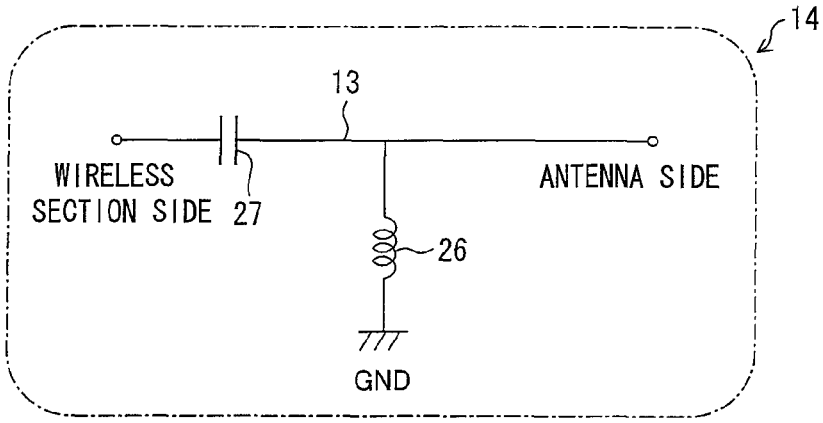
FIG. 21 is a circuit diagram illustrating an example of the circuit configuration of the matching circuit.
Figure 22:
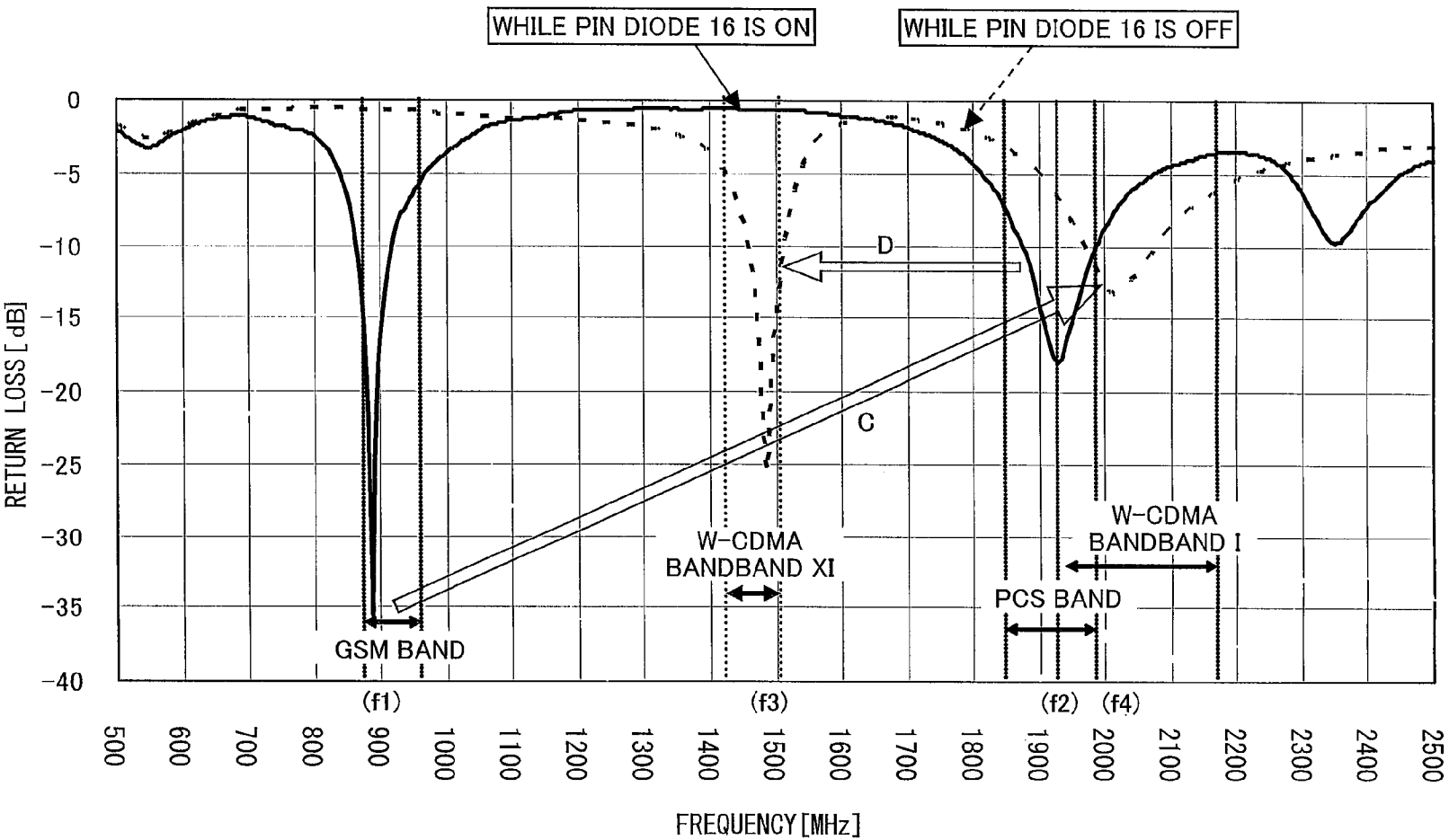
FIG. 22 is a graph illustrating a return loss characteristic of the antenna device according to Example 7.

First, with reference to FIGS. 20, 21, and 22, a case is to be described in which resonance frequencies of the antenna elements 11 and 12 are in conformity with communication systems using a GSM (Global System for Mobile Communications) band, a PCS (Personal Communication Service) band, and a W-CDMA (Wideband Code Division Multiple Access) band. Specifically, in present example, a case is to be described in which the resonance frequencies of the antenna elements 11 and 12 are in conformity with the GSM band and the PCS band, respectively while the PIN diode 16 is on, whereas the resonance frequencies of the antenna elements 11 and 12 are in conformity with a band I and a band XI, respectively of the W-CDMA band while the PIN diode 16 is off.

FIG. 20 is a perspective view illustrating an example of the antenna device 50 according to the present embodiment. The case is to be described, assuming that in FIG. 20, an arrow P31 represents a side of the antenna base 9 on which side the top surface of the antenna base 9 is located, an arrow P32 represents a side of the antenna base 9 on which side the front surface of the antenna base 9 is located.

(Arrangements of Antenna Element and Antenna Base)

The antenna elements 11 and 12 are made of a plate electroconductive member and have a width of 1.5 mm. The antenna base 9 is made of a dielectric material having a relative permittivity of approximately 2. In the present example, the antenna elements 11 and 12 are provided on the antenna base 9 (see FIG. 20).

The antenna element 11 has six straight-line parts K21*a* through K21*f*.

In the present example, lengths of the straight-line parts K21*a* through K21*f* are set to 12 mm, 7 mm, 20 mm, 8 mm, 15 mm, and 6 mm, respectively. Accordingly, the total length L1 of the antenna element 11 is found to be: L1=12+7+20+8+15+6=68 mm Since the other features of the antenna element 11 of the present example are similar to those of the antenna element 11 described with reference to FIG. 7, a description thereof is omitted here.

In contrast, the antenna element 12 has three straight-line parts K22*a* through K22*c*. The straight-line parts K22*a* through K22*c* are connected in series from the straight-line part K22*a* which is a tip of the antenna element 12 to the straight-line part K22*c* which is connected to the antenna connecting section 42 located at the base of the antenna element 12.

The straight-line part K22*c* is provided on the front surface of the antenna base 9, i.e., between the straight-line part K22*b* and the antenna connecting section 42.

The straight line parts K22*a* and K22*b*, which are provided on the top surface of the antenna base 9, are connected at right angles to each other so as to be L-shaped.

Lengths of the straight-line parts K22*a*, K22*b*, and K22*c* are set to 14 mm, 7 mm, and 6 mm, respectively. Accordingly, the total length L2 of the antenna element 12 is found to be: L2=14+7+6=27 mm (Circuit Configuration)

Next, a circuit configuration of the antenna control section 8 of the present example is described below.

First, the matching circuit 14 is described below. FIG. 21 is a circuit diagram illustrating an example of the circuit configuration of the matching circuit 14.

A matching circuit including a chip coil 26 and a chip condenser 27 is used as the matching circuit 14 (see FIG. 21). With the power supply line 13, the chip coil 26 is connected in parallel and the chip condenser 27 is connected in series.

A chip coil (4.3 nH) is used as the chip coil 26, and a chip condenser (5.0 pF) is used as the chip condenser 27.

According to the arrangement, the chip coil 26 of the matching circuit 14 also has the function of the choke coil 21 of FIG. 1 of supplying a direct current, and the chip condenser 27 also has the function of the DC cut 22 of FIG. 1 of interrupting a direct current.

Each of power supply connecting sections 15*a* and 15*b* includes (i) an electroconductive pattern provided on a substrate and (ii) a plate spring.

A resistance (1 kΩ), a choke coil (100 nH), and a DC cut (1000 pF) are used as the resistance 23, the choke coil 24, and the DC cut 25, respectively of the diode control circuit 17.

In order to turn on the PIN diode 16, the control section 19 applies a forward voltage of 3V to each of the diode control circuit 17 and the PIN diode 16.

Assume here that a voltage drop by 0.8V occurs in the PIN diode 16 when the PIN diode 16 is turned on. Since a voltage drop by 2.2V occurs at each of both ends of the resistance 23, a direct current of 2.2 mA flows to the PIN diode 16 based on the Ohm's law. Note that the power supply line has a width of 1.5 mm.

(Return Loss Characteristic)

A return loss characteristic of the antenna device 50 as arranged above is described below with reference to FIG. 22. FIG. 22 is a graph illustrating the return loss characteristic of the antenna device 50 according to the present example.

In the graph of FIG. 22, the return loss characteristic obtained while the PIN diode 16 is on is shown in a solid line, and the return loss characteristic obtained while the PIN diode 16 is off is shown in a dashed line.

While the PIN diode 16 is on, the antenna element 11 resonates in the GSM band (at f1) and the antenna element 12 resonates in the PCS band (at f2) (see FIG. 22). Note that f1 is 900 MHz and f2 is 1920 MHz.

Note here that a relationship among the lengths L1 and L2, the resonance frequencies f1 and f2, and the wavelengths λ1 and λ2 of the antenna elements 11 and 12 of the present example is examined below.

First, since the antenna element 11 operates as the ¼ wavelength antenna, $\lambda 1/4=c/4f1\approx 83$ mm.

Though $L1=\lambda 1/4$ in accordance with the equation [2], L1=68 mm, which is not exactly $L1=\lambda 1/4$.

Further, since the antenna element 11 operates as the ¼ wavelength antenna, $\lambda 2/4=c/4f2\approx 39$ mm.

Though $L2=\lambda 2/4$ in accordance with the equation [2], L2=27 mm, which is not exactly $L2=\lambda 2/4$.

The reason why the equations $L1=\lambda 1/4$ and $L2=\lambda 2/4$ do not exactly hold as described above is due to (i) a wavelength shortening effect brought about by the antenna base 9 which is made of a dielectric material and/or (ii) an influence of a characteristic of the matching circuit 14.

While the PIN diode 16 is off, the antenna element 11 resonates in the band I of the W-CDMA band (at f4: 2000 MHz) and the antenna element 12 resonates in the band XI of the W-CDMA band (at f3: 1480 MHz) (see FIG. 22).

As described earlier, a change in on/off states of the PIN diode 16 causes a change, from f1 to f4 (see an arrow C), in resonance frequency of the antenna element 11. Note here that f4 is substantially twice as high as f1. This causes a change in resonance frequency of the antenna element 11 from the GSM band to the band I of the W-CDMA band.

In contrast, the change in on/off states of the PIN diode 16 causes a change, from f2 to f3 (see an arrow D), in resonance frequency of the antenna element 12. Note here that f3 is lower than f2. This causes a change in resonance frequency of the antenna element 12 from the PCS band to the band XI of the W-CDMA band.

(Effect)

As described earlier, a change in on/off states of the PIN diode 16 allows obtainment of a total of four resonance frequencies and allows these four resonance frequencies to be in conformity with three GSM, W-CDMA (band I and band XI), and PCS communication systems (four communication bands).

Example 8

Subsequently, with reference to FIGS. 23, 24, and 25, a case is to be described in which resonance frequencies of the antenna elements 11 and 12 are in conformity with communication systems using the GSM band, a GPS band, and the PCS band. Specifically, in present example, a case is to be described in which the resonance frequencies of the antenna elements 11 and 12 are in conformity with the GSM band and the PCS band, respectively while the PIN diode 16 is on, whereas the resonance frequency of the antenna element 12 is in conformity with the GPS band while the PIN diode 16 is off.

Figure 23:
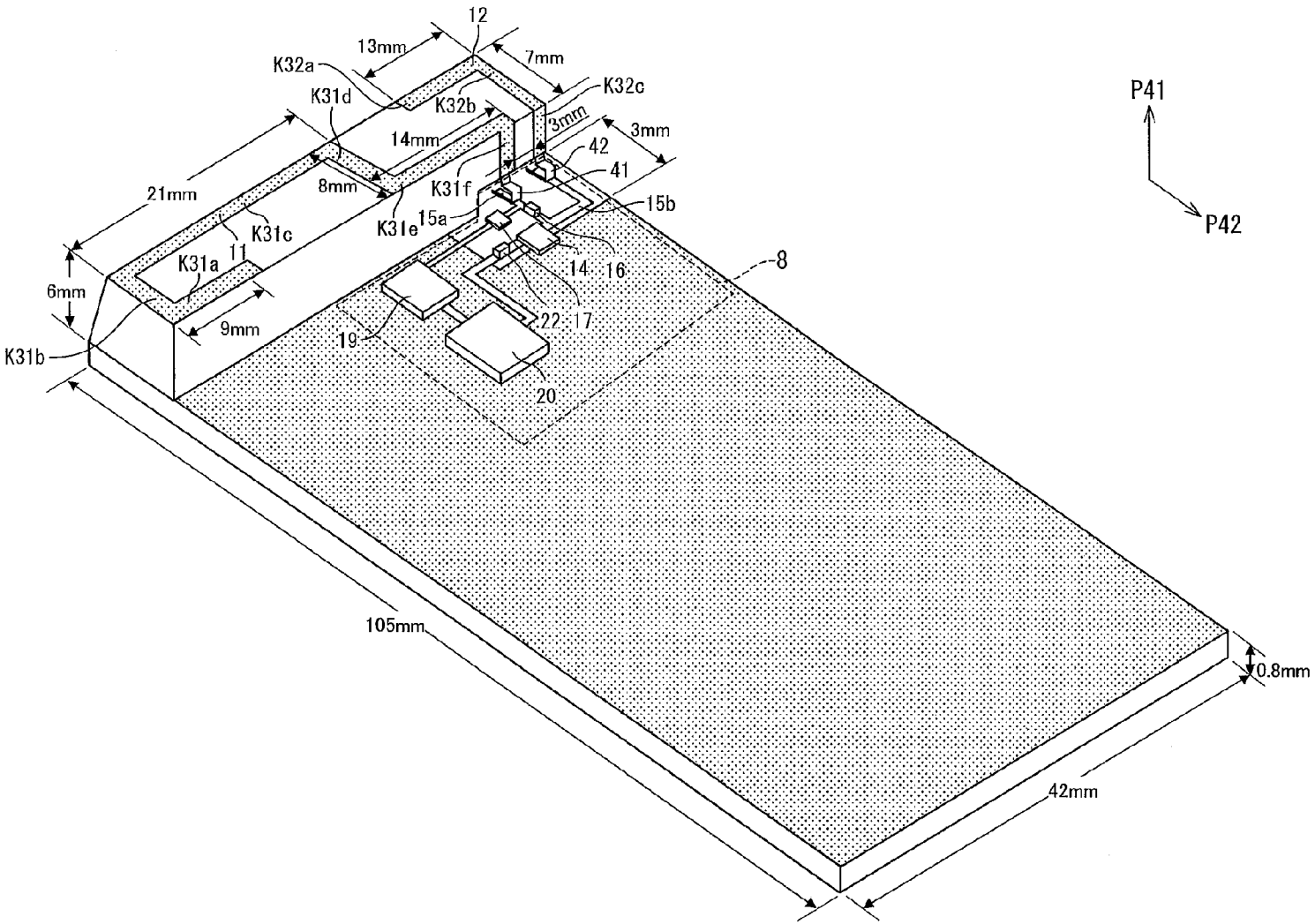
FIG. 23 is a perspective view illustrating a further example of the antenna device according to the embodiment of the present invention.

FIG. 23 is a perspective view illustrating an example of the antenna device 50 according to the present embodiment. The case is to be described, assuming that in FIG. 23, an arrow P41 represents a side of the antenna base 9 on which side the top surface of the antenna base 9 is located, an arrow P42 represents a side of the antenna base 9 on which side the front surface of the antenna base 9 is located.

(Arrangement of Antenna Element)

The antenna element 11 has six straight-line parts K31*a* through K31*f*.

In the present example, lengths of the straight-line parts K31*a* through K31*f* are set to 9 mm, 7 mm, 21 mm, 8 mm, 14 mm, and 6 mm, respectively. Accordingly, the total length L1 of the antenna element 11 is found to be: L1=9+7+21+8+14+6=65 mm Since the other features of the antenna element 11 of the present example are similar to those of the antenna element 11 described with reference to, for example, FIG. 7, a description thereof is omitted here.

In contrast, the antenna element 12 has three straight-line parts K32*a* through K32*c*.

Note that, in the present example, respective lengths of the straight-line parts K32*a*, K32*b*, and K32*c* are set to 13 mm, 7 mm, and 6 mm. Accordingly, the total length L2 of the antenna element 12 is found to be: L2=13+7+6=26 mm Since the other features of the antenna element 12 of the present example are similar to those of the antenna element 12 described with reference to FIG. 20, a description thereof is omitted here.

(Circuit Configuration)

Next, a circuit configuration of the antenna control section 8 of the present example is described below.

First, the matching circuit 14 is described below with reference to FIG. 24. FIG. 24 is a circuit diagram illustrating an example of the circuit configuration of the matching circuit 14.

Figure 24:
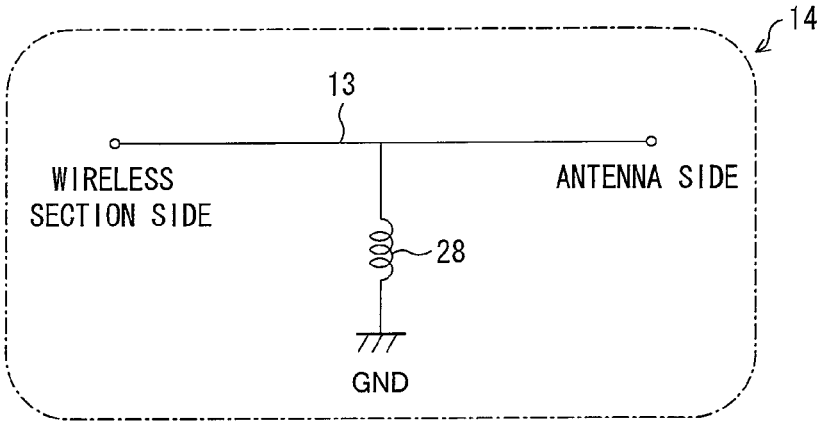
FIG. 24 is a circuit diagram illustrating an example of the circuit configuration of the matching circuit.

A matching circuit including a chip coil 28 which is connected in parallel with the power supply line 13 is used as the matching circuit 14 (see FIG. 24). A chip coil (3.3 nH) is used as the chip coil 28. Note that the chip coil 28 of the matching circuit 14 is provided closer to the antennas than the DC cut 22, so as to further have the function of the choke coil 21 of FIG. 1 of supplying a direct current.

A DC cut (1000 pF) is used as the DC cut 22.

Since arrangements other than those of the matching circuit 14 and the DC cut 22 are similar to those described with reference to FIG. 20, a description thereof is omitted here.

(Return Loss Characteristic)

A return loss characteristic of the antenna device 50 as arranged above is described below with reference to FIG. 25. FIG. 25 is a graph illustrating the return loss characteristic of the antenna device 50 according to the present example.

Figure 25:
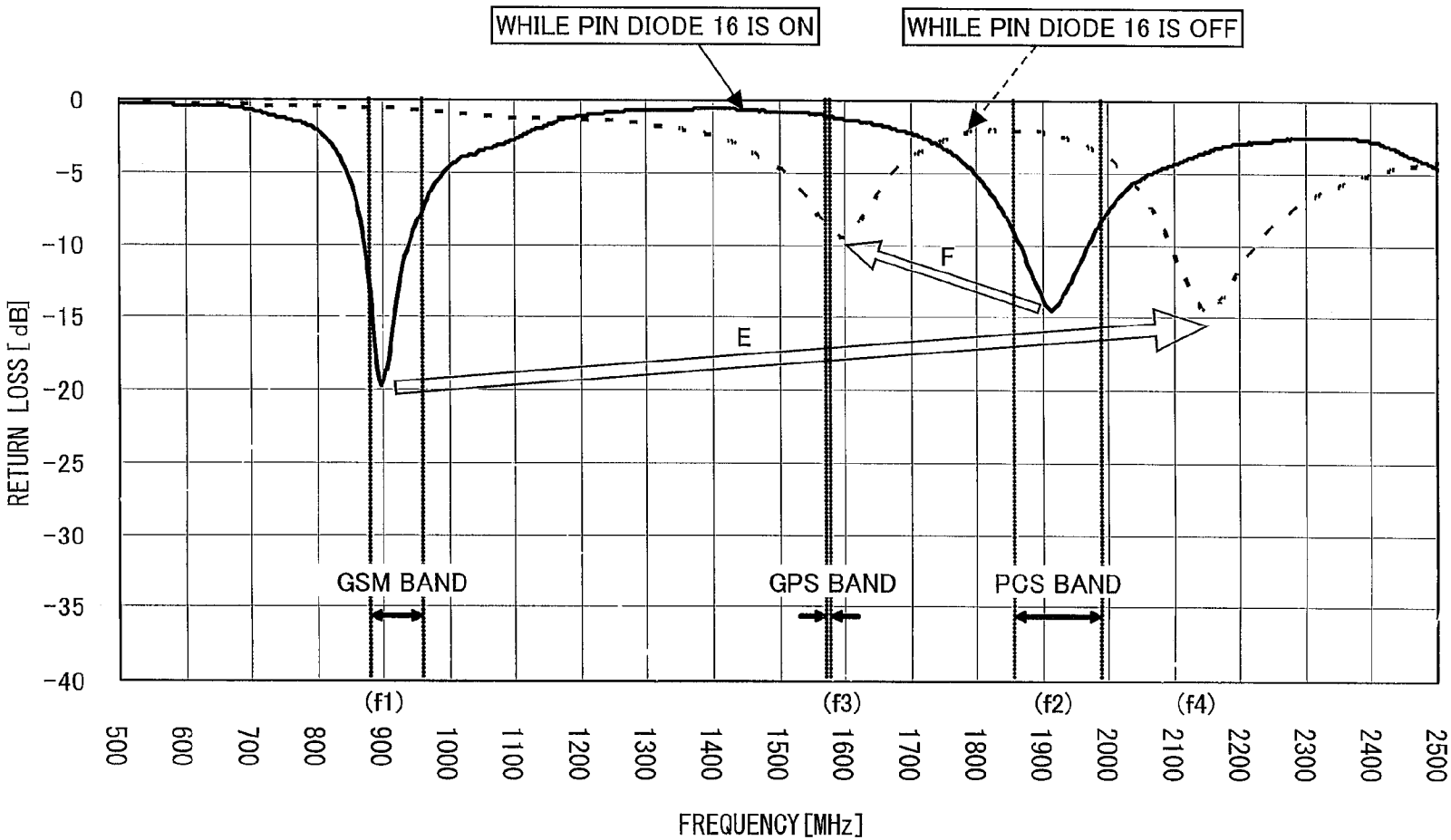
FIG. 25 is a graph illustrating a return loss characteristic of the antenna device according to Example 8.

In the graph of FIG. 25, the return loss characteristic obtained while the PIN diode 16 is on is shown in a solid line, and the return loss characteristic obtained while the PIN diode 16 is off is shown in a dashed line.

While the PIN diode 16 is on, the antenna element 11 resonates in the GSM band (at f1) and the antenna element 12 resonates in the PCS band (at f2) (see FIG. 25).

While the PIN diode 16 is off, the antenna element 12 resonates in the GPS band (at f3), whereas the antenna element 11 resonates in the vicinity of 2150 MHz (at f4) (see FIG. 25). However, there exists no available communication system in the vicinity of this band. Therefore, the antenna element 11 is not used for communication.

As described earlier, a change in on/off states of the PIN diode 16 causes a change, from f1 to f4 (see an arrow E), in resonance frequency of the antenna element 11. Note here that f4 is substantially twice as high as f1.

This causes a change in resonance frequency of the antenna element 11 from the GSM band to the band in which no communication system exists.

In contrast, the change in on/off states of the PIN diode 16 causes a change, from f2 to f3 (see an arrow F), in resonance frequency of the antenna element 12. Note here that f3 is lower than f2. This causes a change in resonance frequency of the antenna element 12 from the PCS band to GPS band.

(Effect)

As described earlier, a change in on/off states of the PIN diode 16 allows obtainment of a total of four resonance frequencies and allows three of the four resonance frequencies to be in conformity with three GSM, GPS, and PCS communication systems.

(Modification)

As described earlier, in each of the cases where the PIN diode 16 is on and off, it is possible to adjust the resonance frequencies of the antenna elements 11 and 12, respectively by changing elements such as a size and a disposition of the antenna elements 11 and 12 and an arrangement of the matching circuit 14.

According to the present embodiment, each of the antenna elements 11 and 12 can obtain two resonance frequencies through the on/off states of the PIN diode 16. Namely, it is possible to obtain a total of four resonance frequencies by two antenna elements. This can realize a reduction in number of antenna elements and miniaturization of a circuit configuration.

Note that a communication system with which the antenna device 50 is in conformity is not limited to the GSM, GPS, PCS, and W-CDMA communication systems. The antenna device 50 can be in conformity with a desired communication system by adjusting a size and a disposition of the antenna elements 11 and 12, an arrangement of the matching circuit 14, and the like.

Namely, Example 7 discusses the case in which all the four resonance frequencies obtained through the on/off states of the PIN diode 16 are in conformity with the given communication systems in the antenna device 50. Further, Example 8 discusses the case in which three of the four resonance frequencies obtained through the on/off states of the PIN diode 16 are in conformity with the given communication systems in the antenna device 50.

As described earlier, it is possible to arrange the antenna device 50 in which a part or all of the obtained plurality of resonance frequencies are in conformity with the given communication systems.

According to the present embodiment, the PIN diode 16 is used as a switch. Alternatively, switch means such as FET or SPDT (Single Pole Double Throw) is also usable.

In the examples mentioned above, in order to cause the antenna elements 11 and 12 to operate as ¼ wavelength antennas, the antenna elements 11 and 12 are described assuming that they are substantially L-shaped. However, the antenna elements 11 and 12 can also be differently shaped, e.g., substantially F-shaped.

According to the present embodiment, the antenna elements 11 and 12 are arranged such that four resonance frequencies are obtained through the on/off states of the PIN diode 16. It is also possible to arrange the antenna elements 11 and 12 so that more than four resonance frequencies are obtained by causing the antenna elements 11 and 12 to be shaped to excite a multiplied wave.

According to the present embodiment, the antenna elements 11 and 12 are arranged to have different lengths so as to resonate at different frequencies. However, the antenna elements 11 and 12 can also have an identical length.

In this case, for example, it is possible to cause the antenna elements 11 and 12 to operate as antennas obtaining a polarization diversity effect since the antenna elements 11 and 12 resonate at an identical frequency while the PIN diode 16 is on. In contrast, it is possible to cause the antenna elements 11 and 12 to be in conformity with communication systems using two frequency bands since the antenna elements 11 and 12 resonate at different frequencies while the PIN diode 16 is off.

According to the present embodiment, power is supplied from power supply line 13 to each of the antenna elements 11 and 12 via the power supply connecting sections 15*a* and 15*b*. However, power can also be supplied from different power supply lines to the antenna elements 11 and 12, respectively.

Note that, in order to turn off the PIN diode 16, it is preferable to apply a reverse voltage to the PIN diode 16. The reason for this is described below.

First, a large high-frequency current unintendedly may flow to the PIN diode 16 during radiation of a transmitted wave. In a case where a forward voltage of 0V is to be applied to the PIN diode 16 but an unintended large high-frequency current flows to the PIN diode 16, the PIN diode 16 may be turned on.

In addition, a desired characteristic(s) and/or a characteristic(s) as designed of an antenna and/or a circuit may not be obtainable when the PIN diode 16 is turned on in such an unintended case.

Further, the PIN diode 16 has a large harmonic distortion due to its nonlinearity when the PIN diode 16 is turned on in such an unintended manner. This may cause a twofold wave, a threefold wave, or the like to be unnecessarily radiated during the radiation of the transmitted wave.

In contrast, application of a reverse voltage to the PIN diode 16 can determine a bias and prevent the PIN diode 16 from being turned on due to an induced potential or the like.

Further, in order to radiate the transmitted wave while the PIN diode 16 is on, it is preferable to supply, to the PIN diode 16, a current which is in proportion to a level of transmission power under which the transmitted wave is radiated. This can prevent the PIN diode 16 from having a harmonic distortion due to its nonlinearity.

Specifically, the PIN diode 16 has a nonlinear operating characteristic and consequently has a large harmonic distortion in a case where a supply of a direct current of 2 mA to 3 mA turns on the PIN diode 16. A larger level of transmission power under which the transmitted wave is radiated causes a twofold wave, a threefold wave, or the like to be unnecessarily radiated.

In contrast, since the PIN diode 16 has a linear operating characteristic in a case where a supply of a direct current of 10 mA turns on the PIN diode 16, it is possible to prevent the PIN diode 16 from having a harmonic distortion.

Figure 26:
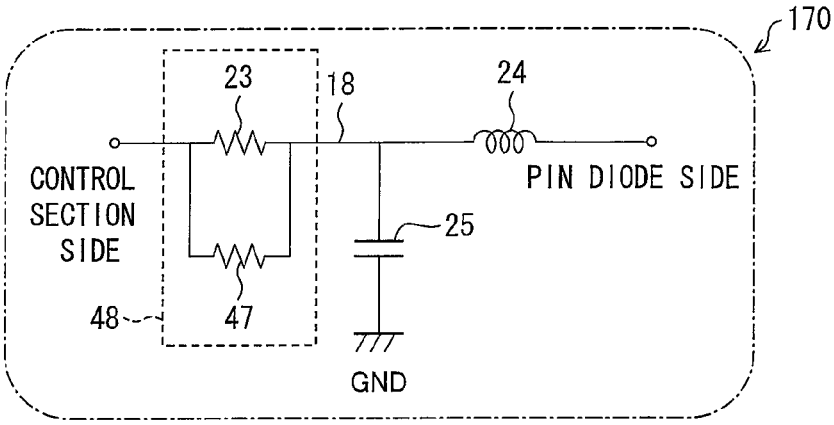
FIG. 26 is a circuit diagram illustrating a modification of the circuit configuration of the diode control circuit.

An example of a diode control circuit (direct current supply means) 170 which controls a direct current to be supplied to the PIN diode 16 is described below with reference to FIG. 26. FIG. 26 is a circuit diagram illustrating a modification of the circuit configuration of the diode control circuit 17.

The diode control circuit 170 of FIG. 26 is obtained by causing the diode control circuit 17 of FIG. 5 to further include a resistance 47 provided in parallel with the resistance 23. Since the other arrangements of the diode control circuit 170 are similar to those of the diode control circuit 17 of FIG. 5, a description thereof is omitted here.

The resistance 47 included in the diode control circuit 170 causes a combined resistance 48 of the resistance 23 and the resistance 47 to be smaller than the resistance 23. This allows a direct current flowing to the PIN diode 16 to be larger than in the case of the resistance 23 alone.

The resistance 47 can include a switch (not illustrated) to change the on/off states of the PIN diode 16 in accordance with a level of transmission power. Alternatively, the resistance 47 can cause the switch to control a level of a direct current flowing to the PIN diode 16.

Further, the diode control circuit 170 can be arranged to include a plurality of resistances each of which includes a switch to change the on/off states of the PIN diode 16 in accordance with a level of transmission power and which are provided in parallel with the resistance 23. According to the arrangement, it is possible to flexibly adjust a level of a direct current flowing to the PIN diode 16 since the on/off states of the PIN diode 16 are changed by the plurality of resistances in accordance with a level of transmission power.

Second Embodiment

Another embodiment of an antenna device of the present invention is described below with reference to FIGS. 27 to 29. The present embodiment discusses a case in which impedance matching is adjustable in a matching circuit in accordance with a change in on/off states of a PIN diode 16. The following description discusses an example of an antenna device which allows, by such an adjustment function, resonance frequencies to be in conformity with systems using six bands of a GSM band, a GPS band, a DCS (Digital Cellular System) band, a PCS band, a W-CDMA band, and an ISM (Industry-Science-Medical) band.

(Circuit Configuration of Antenna Device)

Next, a circuit configuration of an antenna device 500 according to the present embodiment is to be described with reference to FIG. 27. FIG. 27 is a schematic view schematically illustrating the circuit configuration of the antenna device 500.

Note, for convenience, members having functions identical to those of the respective members illustrated in the drawings of the First Embodiment are given respective identical reference numerals, and a description of those members is omitted here.

Figure 27:
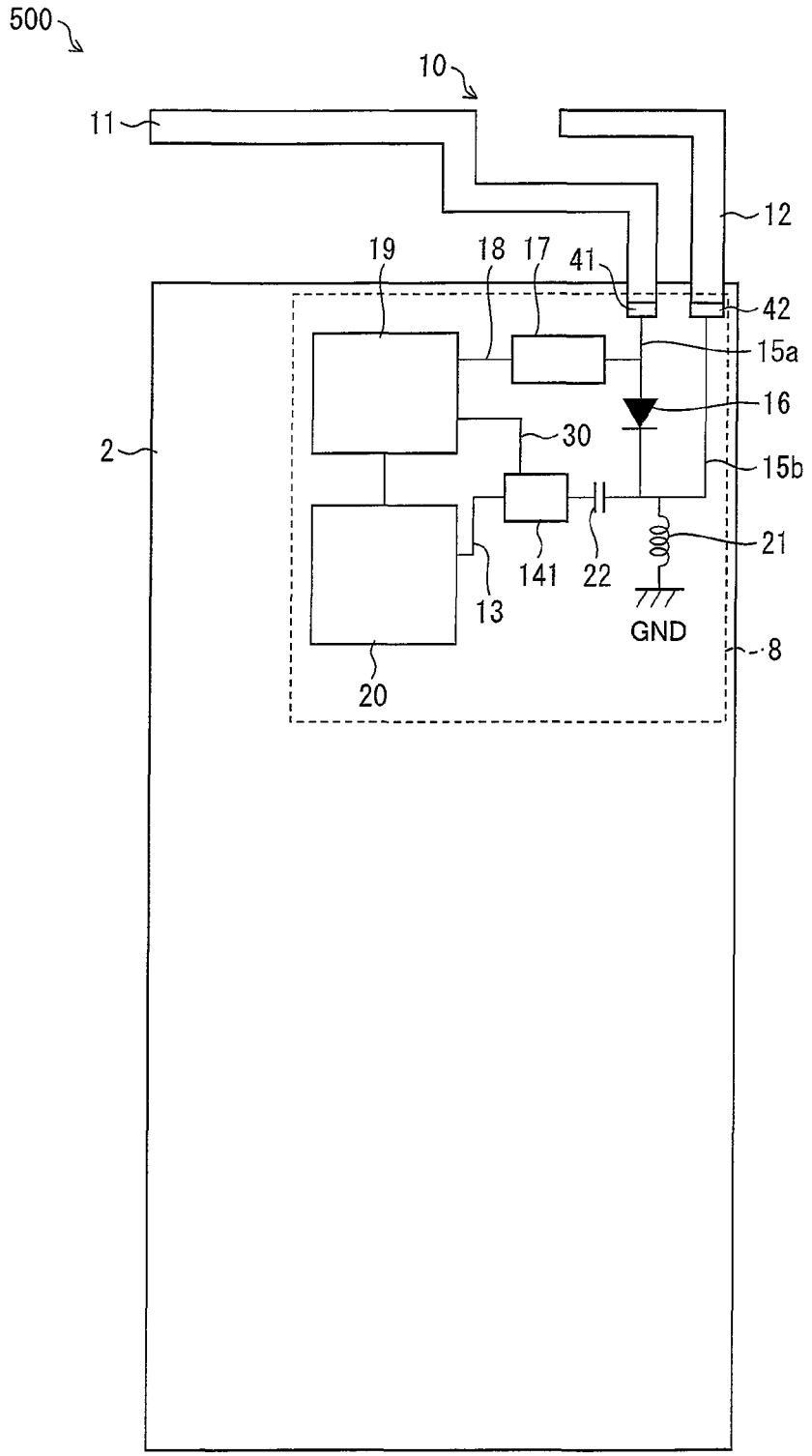
FIG. 27 is a schematic view schematically illustrating a circuit configuration of the antenna device.

A point of difference between the antenna device 50 of FIG. 4 and the antenna device 500 of FIG. 27 is described below.

An interior of a matching circuit (an impedance matching circuit) 141 of the antenna device 500 of FIG. 27 is significantly differently arranged from that of the matching circuit 14 of the First Embodiment. In addition, the antenna device 500 of FIG. 27 is different from the antenna device 50 of FIG. 4 in that a control section 19 and the matching circuit 141 are connected via a signal line 30.

Since the other arrangements of the antenna device 500 are as described earlier, a description thereof is omitted here.

(Matching Circuit)

The matching circuit 141 according to the present embodiment is to be described with reference to FIG. 28. FIG. 28 is a circuit diagram illustrating a circuit configuration of the matching circuit 141 according to the present embodiment.

Figure 28:
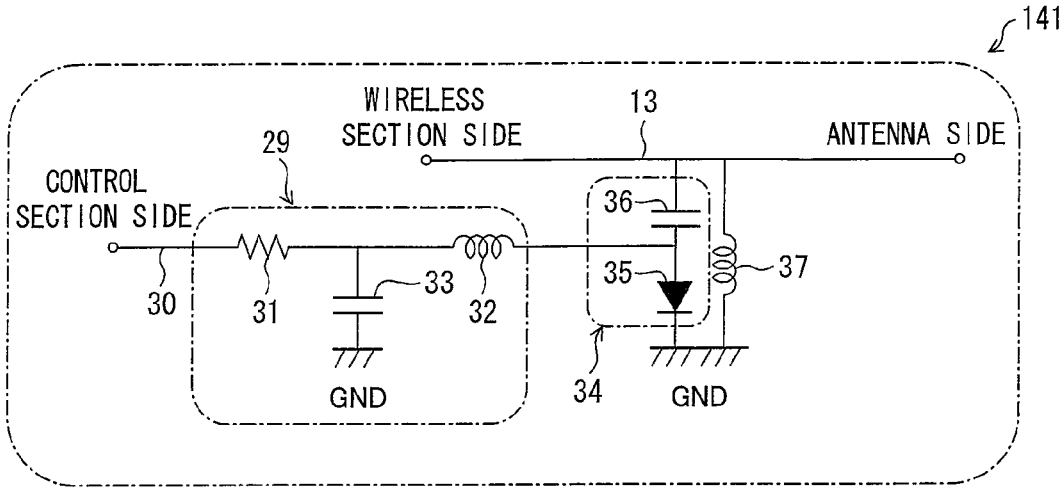
FIG. 28 is a circuit diagram illustrating a circuit configuration of a matching circuit according to another embodiment of the present invention.

The matching circuit 141 includes a diode control circuit 29, a variable reactance element 34, and a chip coil 37 (see FIG. 28).

The diode control circuit 29 includes a resistance 31, a choke coil 32, and a DC cut 33.

The diode control circuit 29 is connected to the signal line 30 (see FIG. 28). On the other hand, the diode control circuit 29 is connected with the variable reactance element 34.

The diode control circuit 29 is arranged such that the resistance 31 and the choke coil 32 are connected in series with the signal line 30 in order from the control section 19 side and the DC cut 33 is connected in parallel with the signal line 30.

The variable reactance element 34 includes a PIN diode 35 and a chip condenser 36. The variable reactance element 34 is connected in parallel with a power supply line 13 while being connected with the diode control circuit 29.

The diode control circuit 29 is connected to an anode of the PIN diode 35 in the variable reactance element 34. More specifically, the choke coil 32 of the diode control circuit 29 is connected between the anode of the PIN diode 35 and the chip condenser 36 of the variable reactance element 34.

The chip coil 37 is connected in parallel with the power supply line 13.

(Operation of Antenna Device)

As described earlier, the control section 19 controls a voltage to be applied to each of the diode control circuit 17 and the PIN diode 16, so as to change the on/off states of the PIN diode 16. According to the present embodiment, the control section 19 sends a control signal to the matching circuit 141 via the signal line 30 in response to a change in on/off states of the PIN diode 16, so as to adjust impedance matching in the matching circuit 141.

More specifically, the control section 19 controls a current flowing into the PIN diode 35 by sending a control signal to the diode control circuit 29 of the matching circuit 141 and then changes the on/off states of the PIN diode 35 so as to adjust impedance matching.

Figure 29:
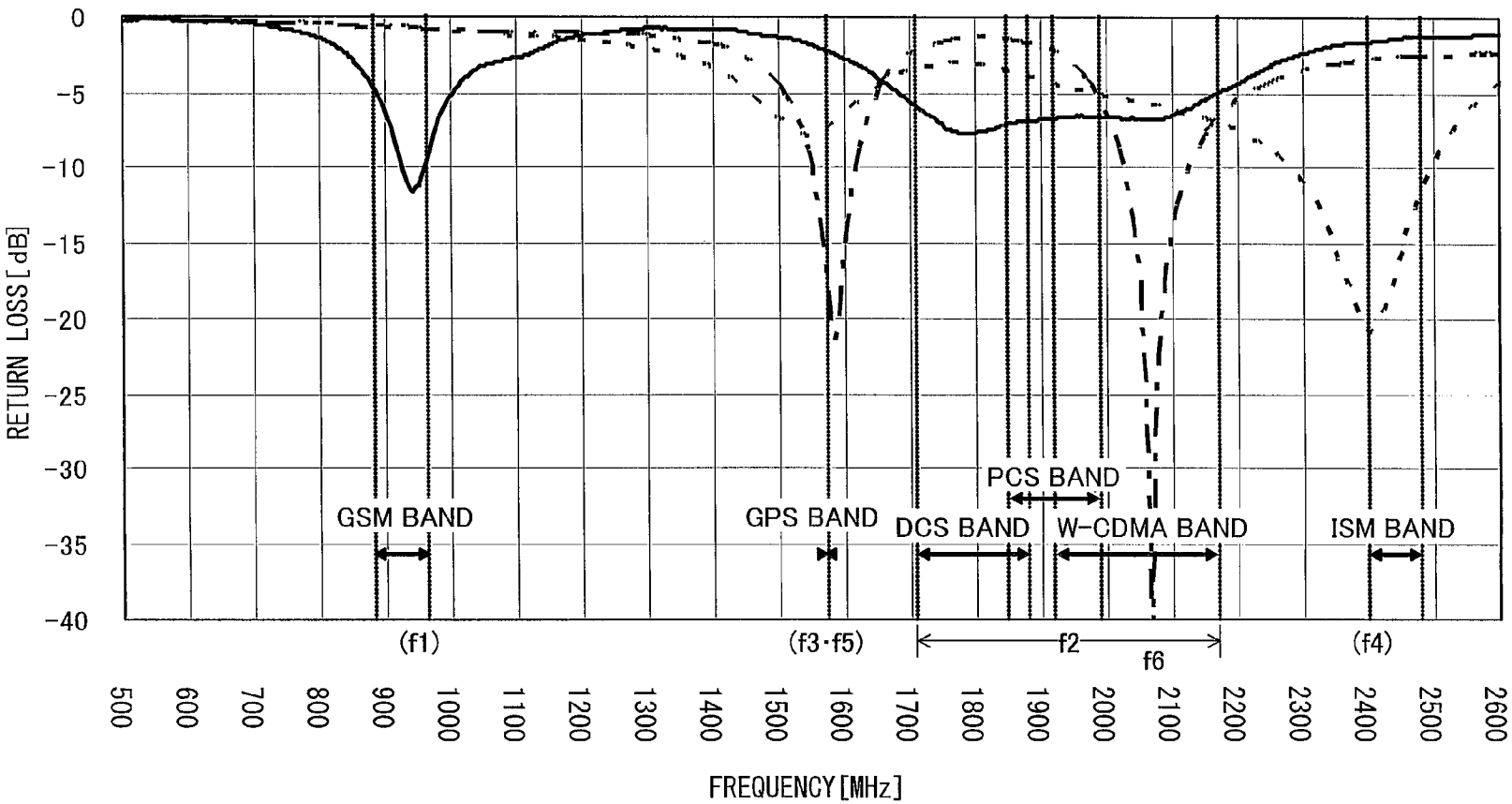
FIG. 29 is a graph illustrating a return loss characteristic of an antenna device according to another embodiment of the present invention.

This allows obtainment of a return loss characteristic as illustrated in FIG. 29. FIG. 29 is a graph illustrating a return loss characteristic of the antenna device 500 according to the present embodiment.

The antenna device 500 is arranged such that the control section 19 controls a change in on/off states of the PIN diode 16 and adjusts impedance matching in the matching circuit 141, so as to obtain a plurality of resonance frequencies in an antenna section 10 (see FIG. 29).

In the graph of FIG. 29, the return loss characteristic obtained (i) while the PIN diode 16 is on is shown in a solid line, the return loss characteristic obtained (ii) while the PIN diode 16 is off and the PIN diode 35 is on is shown in a dashed line, and the return loss characteristic obtained (iii) while the PIN diode 16 is off and the PIN diode 35 is off is shown in a dashed-dotted line. The following description specifically discusses the above cases (i) through (iii).

(While Pin Diode 16 is On)

The control section 19 applies a forward voltage of not less than a specified value to the PIN diode 35 via the diode control circuit 29, so as to turn on the PIN diode 35.

In this case, an antenna element 11 resonates in the GSM band (at f1). In contrast, an antenna element 12 resonates in a broad band (at f2) due to parallel resonance of the chip condenser 36 and the chip coil 37 which are included in the matching circuit 141. The antenna element 12 resonates in three bands of the DCS band, the PCS band, and the W-CDMA band (see FIG. 29). Namely, the antenna device 500 can communicate with the GSM, DCS, PCS, and W-CDMA communication systems.

(While Pin Diode 16 is Off)

The following description discusses, with reference to FIG. 29, cases where the PIN diode 35 is on and off while the PIN diode 16 is off.

(1) While PIN Diode 35 is On

The antenna element 11 resonates in the ISM band (at f4) while the PIN diode 35 is on (see FIG. 29). The antenna element 12 resonates in the GPS band (at f3). Namely, the antenna device 500 can communicate with the ISM and GPS communication systems.

The return loss characteristic shown in the dashed line in FIG. 29 is substantially equivalent to that obtained in the case of a circuit in which impedance matching cannot be changed.

(2) While PIN Diode 35 is Off

Impedance matching between each of the antenna elements 11 and 12 and the power supply line 13 is adjusted only by the chip coil 37 while the PIN diode 35 is off. This causes a change in impedance, so that the antenna element 12 resonates in the GPS band (at f5) (see FIG. 29). Note here that strong resonance occurs at f5 than at f3 at which the antenna element 12 resonates while the PIN diode 35 is on, so that a better return loss characteristic is obtained.

Note that the antenna element 11, which resonates at 2070 MHz (f6), is usable for communication carried out in the W-CDMA band (see FIG. 29).

As described earlier, since there exists a frequency f6 at which a better return loss characteristic is obtained in the W-CDMA band than that obtained while the PIN diode 16 and the PIN diode 35 are on, communication can be carried out in the W-CDMA band by turning off the PIN diode 16 and the PIN diode 35.

(Effect)

As described earlier, the antenna device 500 of the present embodiment is capable of communicating with communication systems in the six frequency bands by the two antenna elements 11 and 12.

This allows obtainment of more resonance frequencies without the need of additionally providing an antenna element and a transmission/reception circuit, so that the antenna device 500 can be miniaturized.

Note that, according to the present embodiment, the variable reactance element 34 includes the PIN diode 35 provided between the condenser 36 and a ground (GND) which are connected in parallel. However, the variable reactance element 34 can be replaced with a variable reactance element such as a varicap. Alternatively, a variable reactance element which is differently arranged from the variable reactance element 34 of FIG. 28 can be realized by use of an FET or an SPDT.

A communication system with which the antenna device 500 is to be in conformity by adjustment of impedance matching in the matching circuit 141 by the control section 19 is not limited to the communication systems using the GSM band, the GPS band, the DCS band, the PCS band, the W-CDMA band, and the ISM band. Alternatively, it is possible to adjust impedance matching so that the antenna device 500 is in conformity with a band for use in another communication system.

CONCLUSION

As described earlier, each of the antenna devices 50 and 500 according to the Embodiments includes the antenna elements 11 and 12, the wireless section 20 for supplying power to each of the antenna elements (11) and (12), the PIN diode 16 for electrically connecting and disconnecting the antenna element (11) and the wireless section (20) with/from each other, the antenna elements (11) and (12) being provided so as to be capacitively coupled to each other during the electrical disconnection between the antenna element 11 and the wireless section 20 which electrical disconnection is made by the PIN diode 16.

This brings about an effect of obtaining at least three resonance frequencies by two antenna elements.

The present invention is not limited to the description of the embodiments above, but may be altered by a skilled person within the scope of the claims. An embodiment based on a proper combination of technical means disclosed in different embodiments is encompassed in the technical scope of the present invention.

Further, the present invention can be described as below. Namely, an antenna device according to the present invention includes: a first antenna element; a second antenna element; a power supply section for supplying power to each of the first antenna element and the second antenna element; and a switching element for electrically connecting and disconnecting the first antenna element and the power supply section with/from each other, the first antenna element and the second antenna element being provided so as to be capacitively coupled to each other during the electrical disconnection between the first antenna element and the power supply section which electrical disconnection is made by the switching element.

Accordingly, it is possible to obtain at least three resonance frequencies by the first antenna element and the second antenna element.

The antenna device according to the present invention is preferably arranged to further include: a first power supply path through which the first antenna element and the power supply section are electrically connected; and a second power supply path through which the second antenna element and the power supply section are electrically connected, the switching element being provided in the first power supply path, the first antenna element and the first power supply path are connected with each other at a first connecting part, the second antenna element and the second power supply path are connected with each other at a second connecting part, a distance between the first connecting part and the second connecting part being more than 0 (zero) and not more than $\lambda/15$ which is one-fifteenth of a wavelength $\lambda$ where an electrical length of the first antenna element is $\lambda/4$.

The arrangement specifically illustrates that the first antenna element and the second antenna element can be electrically coupled.

Namely, the first antenna element and the second antenna element can be electrically coupled due to a positional relationship such that the distance between the first connecting part at which the first antenna element and the first power supply path are connected with each other and the second connecting part at which the second antenna element and the second power supply path are connected with each other is set to more than 0 (zero) and not more than $\lambda/15$ which is one-fifteenth of the wavelength $\lambda$ where an electrical length of the first antenna element is $\lambda/4$.

The antenna device according to the present invention is preferably arranged such that the switching element is a semiconductor element which becomes conductive or non-conductive according to whether or not a forward voltage of a specified value is applied to the switching element.

According to the arrangement, the first antenna element and the power supply section are electrically connected or disconnected with/from each other according to whether or not the forward voltage of the specified value is applied to the semiconductor element serving as the switching element. Namely, the application of the forward voltage of the specified value to the switching element causes the first power supply path to be closed. In contrast, application of the forward voltage of not more than the specified value to the switching element causes the first power supply path to be open. As described earlier, control of the forward voltage to be applied to the switching element brings about an effect of controlling the closing/opening of the first power supply path without the need of providing a complicated system.

Note that a PIN diode, an FET (Field Effect Transistor), or the like is usable as such a switching element. Note also that a forward voltage of a specified value can be set in accordance with such a semiconductor element.

The antenna device according to the present invention is preferably arranged such that the switching element makes the electrical disconnection between the first antenna element and the power supply section in response to application of a reverse voltage to the switching element.

The application of the forward voltage of less than the specified value to the switching element causes the switching element to be non-conductive. However, a large high-frequency current may unintendedly flow to the switching element during radiation of a transmitted wave. This causes the switching element to be conductive, so that a desired characteristic and/or a characteristic as designed of the antenna device may not be obtainable.

Further, the switching element has a large harmonic distortion due to its nonlinearity when the switching element unintendedly becomes conductive. This may cause a twofold wave, a threefold wave, or the like to be unnecessarily radiated during the radiation of the transmitted wave.

According to the arrangement, the application of the reverse voltage to the switching element can determine a bias and prevent the switching element from being unintendedly turned on due to an induced potential or the like.

The antenna device according to the present invention is preferably arranged to further include direct current supply means for supplying a direct current to the switching element during the electrical connection between the first antenna element and the power supply section, the direct current being in proportion to a level of transmission power under which a transmitted wave is radiated from each of the first antenna element and the second antenna element.

According to the arrangement, it is possible to prevent the switching element from having a harmonic distortion due to its nonlinearity.

For example, the switching element has a nonlinear operating characteristic and consequently has a large harmonic distortion in a case where a supply of a direct current of 2 mA to 3 mA causes the switching element to be conductive. A larger level of transmission power under which the transmitted wave is radiated causes a twofold wave, a threefold wave, or the like to be unnecessarily radiated.

In contrast, since the switching element has a linear operating characteristic in a case where a supply of a direct current of 10 mA causes the switching element to be conductive, it is possible to prevent the switching element from having a harmonic distortion.

The antenna device according to the present invention is preferably arranged to further include an impedance matching circuit for changing a impedance matching value in accordance with whether the first antenna element and the power supply section are electrically connected or disconnected with/from each other by the switching element.

According to the arrangement, it is possible to bring about an effect of adjusting a degree of resonance and/or a resonance frequency in accordance with a change in impedance matching value.

The antenna device according to the present invention is preferably arranged such that a ratio between (i) a resonance frequency f which is in association with the wavelength $\lambda$ and (ii) a frequency f' at which the second antenna element resonates is substantially 1:2.

According to the arrangement in which the ratio between (i) the resonance frequency f which is in association with the wavelength $\lambda$ and (ii) the frequency f' at which the second antenna element resonates is substantially 1:2, it is possible to obtain an excellent antenna characteristic. Specifically, the antenna device as arranged above tends to show an excellent return loss characteristic.

The antenna device according to the present invention is preferably arranged such that: the first antenna element and the second antenna element are at right angles to each other; and the first antenna element and the second antenna element have an identical electrical length during the electrical connection between the first antenna element and the power supply section.

According to the arrangement, it is possible to obtain a polarization diversity effect since (i) the first antenna element and the second antenna element, which have an identical electrical length during the electrical connection between the first antenna element and the power supply section which electrical connection is made by the switching element, operate at an identical resonance frequency and (ii) the first antenna element and the second antenna element are at right angles to each other.

In contrast, since the first antenna element and the second antenna element resonate at different resonance frequencies during the electrical disconnection between the first antenna element and the power supply section which electrical connection is made by the switching element, communication can be carried out in two frequency bands in the antenna device.

The antenna device according to the present invention is preferably arranged such that frequencies at which the first antenna element and/or the second antenna element resonate are in conformity with different frequency bands for use in wireless communication systems, depending on whether the first antenna element and the power supply section are electrically connected or disconnected with/from each other.

According to the arrangement, it is possible to change wireless communication systems for use in communication, depending on whether the first antenna element and the power supply section are electrically connected or disconnected with/from each other. Namely, wireless communication systems can be changed in accordance with whether the first antenna element and the power supply section are electrically connected or disconnected with/from each other by the switching element.

Examples of a wireless communication system include: GSM (Global System for Mobile Communications), PCS (Personal Communication Service), W-CDMA (Wideband Code Division Multiple Access), Wireless LAN (Local Area Network), television broadcasting, Bluetooth (Registered Trademark), and GPS (Global Positioning System).

The antenna device according to the present invention is preferably applicable to a wireless communication terminal. For example, it is possible to carry out communication by use of various wireless communication systems by causing frequencies at which the first antenna element and/or the second antenna element resonate to be in conformity with different frequency bands for use in wireless communication systems.

Examples of the wireless communication terminal include: a mobile phone, a personal computer, a base station, a PDA (Personal Digital Assistant), and a game machine.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention, which makes three resonance frequencies available by use of two antenna elements, is applicable to devices for carrying out wireless communication (wireless communication terminals) such as a base station, a mobile terminal, and a mobile phone.

REFERENCE SIGNS LIST

1 Mobile phone (Wireless communication terminal)
2 Circuit board
8 Antenna control section
9 Antenna base
10 Antenna section
11, 12 Antenna element (First antenna element, Second antenna element)
13 Power supply line
14 Matching circuit (Impedance matching circuit)
141 Matching circuit (Impedance matching circuit)
15*a*, 15*b* Power supply connecting section (First power supply path, Second power supply path)
16 PIN diode (Switching element, Semiconductor element)
17, 170 Diode control circuit (Direct current supply means)
19 Control section
20 Wireless section (Power supply section)
41, 42 Antenna connecting section (Connecting part)
50 Antenna device
58 Switch section
59 Communication control section
500 Antenna device

The invention claimed is:

1. An antenna device comprising:
a first antenna element;
a second antenna element;
a power supply section configured to supply a high-frequency current to the second antenna element;
a switching element configured to electrically connect and disconnect the first antenna element and the power supply section with/from each other;
a first power supply path through which the first antenna element and the power supply section are electrically connected; and
a second power supply path through which the second antenna element and the power supply section are electrically connected, wherein
the switching element being provided in the first power supply path,
the high-frequency current is supplied to the first antenna element via the switching element during the electrical connection between the first antenna element and the power supply section which electrical connection is made by the switching element, and
the first antenna element and the second antenna element being provided so as to be capacitively coupled to each other during the electrical disconnection between the first antenna element and the power supply section which electrical disconnection is made by the switching element.

2. The antenna device as set forth in claim 1,
the first antenna element and the first power supply path are connected with each other at a first connecting part,
the second antenna element and the second power supply path are connected with each other at a second connecting part, and
a distance between the first connecting part and the second connecting part being more than 0 (zero) and not more than $\lambda/15$ which is one-fifteenth of a wavelength $\lambda$, where an electrical length of the first antenna element is $\lambda/4$.

3. The antenna device as set forth in claim 1, wherein the switching element is a semiconductor element which becomes conductive or non-conductive according to whether or not a forward voltage of a specified value is applied to the switching element.

4. The antenna device as set forth in claim 3, wherein the switching element is further configured to make the electrical disconnection between the first antenna element and the power supply section in response to application of a reverse voltage to the switching element.

5. The antenna device as set forth in claim 3, further comprising:
a direct current supply circuit configured to supply a direct current to the switching element during the electrical connection between the first antenna element and the power supply section, wherein
the direct current being in proportion to a level of transmission power under which a transmitted wave is radiated from each of the first antenna element and the second antenna element.

6. The antenna device as set forth in claim 1, further comprising:
an impedance matching circuit configured to change a impedance matching value in accordance with whether the first antenna element and the power supply section are electrically connected or disconnected with/from each other by the switching element.

7. The antenna device as set forth in claim 2, wherein a ratio between (i) a resonance frequency f which is in association with the wavelength λ and (ii) a frequency f' at which the second antenna element resonates is substantially 1:2.

8. The antenna device as set forth in claim 1, wherein:

the first antenna element and the second antenna element are at right angles to each other; and the first antenna element and the second antenna element have an identical electrical length during the electrical connection between the first antenna element and the power supply section.

9. The antenna device as set forth in claim 1, wherein frequencies at which the first antenna element and/or the second antenna element resonate are in conformity with different frequency bands for use in wireless communication systems, depending on whether the first antenna element and the power supply section are electrically connected or disconnected with/from each other.

10. A wireless communication terminal comprising an antenna device recited in claim 1.

11. The antenna device as set forth in claim 1, wherein the switching element is provided between the first antenna element and the power supply section.

* * * * *